United States Patent [19]

Frias et al.

[11] 4,453,872

[45] Jun. 12, 1984

[54] HANDLING APPARATUS FOR PIPE AND OTHER TUBULARS

[75] Inventors: Robert Frias, Odessa; Troy D. Cain, Fort Worth, both of Tex.; John J. Gallagher, Jr., Jeanerette; William Watson, Lafayette, both of La.

[73] Assignee: Ingram Corporation, New Orleans, La.

[21] Appl. No.: 328,252

[22] Filed: Dec. 7, 1981

[51] Int. Cl.[3] ..... E21B 19/14

[52] U.S. Cl. ..... 414/22; 198/719; 198/814; 414/745; 414/786

[58] Field of Search ..... 414/22, 276, 745, 747, 414/748, 786; 175/52, 85; 211/60 S; 198/719, 814; 267/141.1, 153; 212/185, 183

[56] References Cited

U.S. PATENT DOCUMENTS

| | | | |
|---|---|---|---|
| 1,822,026 | 9/1931 | Guy | 267/141.1 |
| 2,535,546 | 12/1950 | Pitts | 414/22 |
| 2,742,260 | 4/1956 | Patterson | 212/185 X |
| 3,159,286 | 12/1964 | Freeman | 414/22 |
| 3,655,071 | 4/1972 | Langowski et al. | 414/22 |
| 3,810,553 | 5/1974 | Crocker et al. | 414/22 |
| 4,051,956 | 10/1977 | Teague | 414/22 X |
| 4,067,453 | 1/1978 | Moller | 414/22 |
| 4,235,566 | 11/1980 | Beeman et al. | 414/22 |
| 4,371,302 | 2/1983 | Frias et al. | 414/22 |

FOREIGN PATENT DOCUMENTS

| | | | |
|---|---|---|---|
| 1367982 | 6/1964 | France | 212/183 |

*Primary Examiner*—Leslie J. Paperner

*Attorney, Agent, or Firm*—Lalos, Leeds, Keegan, Lett & Marsh

[57] ABSTRACT

An apparatus for transferring tubulars between pipe racks and a drilling rig floor including a stationary trough located below and extending towards the drilling rig and a movable trough aligned with the stationary trough having one end supported on the drilling rig floor and the other end powered to move between a lower position for transferring pipe to and from the stationary through and on upper position for transferring pipe to and from the drilling rig floor. A carriage having a frictional coating and wheels which run on guide structure below the stationary trough pushes and guides the pipe along the stationary trough. An endless chain system drives this carriage along the length of the stationary trough and includes a shock absorber system for dampening the forces on the carriage and chain when a pipe impacts the carriage. Two pair of legs extending between pipe racks and the stationary trough are provided. Chain driven lugs driven by a single shaft engage a length of pipe and carry it along the length of the legs. The legs are hinged at a middle section so that they may be easily folded for transport of the apparatus between drilling rig sites. In lieu of this lug mechanism, the legs can be pivoted by fluid actuated cylinders, which are pivotally attached to the apparatus and to the legs, between lower loading and upper unloading positions.

50 Claims, 48 Drawing Figures

212g
212j
212h
212b
212f
212d
212c
212e
212a
212k
212m
212
58
52
12
P
R
C

FIG. 27.
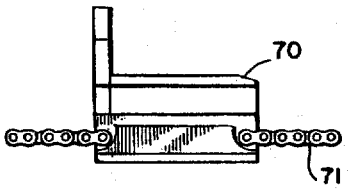
FIG. 28.
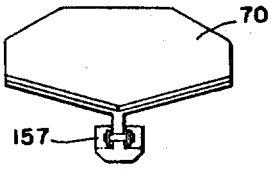
FIG. 33.
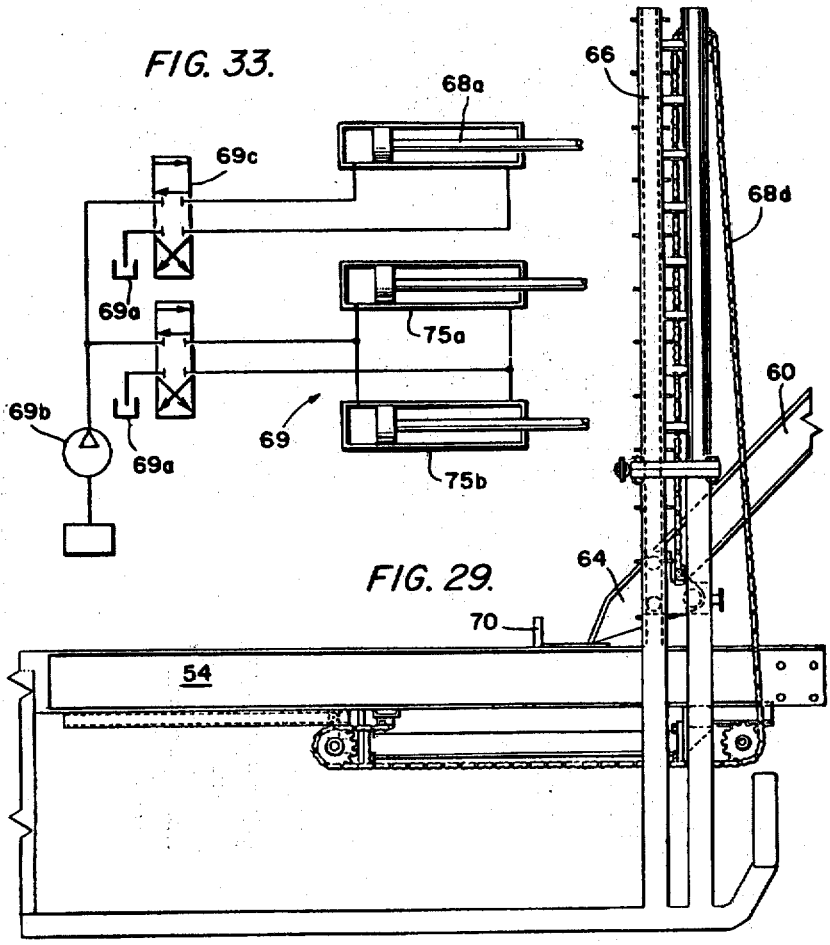
FIG. 29.

HANDLING APPARATUS FOR PIPE AND OTHER TUBULARS

BACKGROUND OF THE INVENTION

This invention relates to an apparatus for handling tubular goods such as pipe, casing, collars, etc. and for transferring such tubular goods between a drilling rig and a pipe rack. It relates more particularly to a pipe handling apparatus which can be easily disassembled, transported between drilling rig sites and reassembled at the new site.

In the prior art there are various methods and devices for lifting and moving pipe to and from pipe racks and an elevated drilling rig floor. One of such methods simply attaches a wire cable to the pipe and then the cable is lifted by a hydraulic winch which is typically mounted on a truck parked near the rig. Cranes and hydraulic driven chains have also been used to lift and move the pipe. As these heavy lengths of pipe impact against the different chain-driven mechanisms, the chains were caused to "jump" or tear the sprockets or the chain. Pipe transferred by these methods can be dropped on personnel or equipment below causing severe injury and damage inasmuch as the pipe can weigh thousands of pounds and often must be lifted to heights of forty feet or more. Additionally, if the pipe is dropped or banged against other structure, or even if it contacts the device in accordance with its operating mode, the threaded ends can be damaged or the pipe bent.

Inclined troughs for the transfer of pipe have also been used wherein the pipe is frictionally slid along the trough surface. This action often causes excessive wear on pipe especially the threaded ends which must be protected from such wear. It was thus often necessary to keep the metal thread protector on as the pipe was moved along the trough for removal when the pipe was on the drilling rig platform. This necessary care of the threads and pipe ends creates an extra step in the installation of the pipe or other tubular in the hole resulting in a longer cycle time.

The prior devices, especially when designed for onshore operations, should be easily disassembled, moved to the flatbed of a truck positioned nearby, driven to another drilling rig site, unloaded from the truck to the proper position and reassembled. In the past this operation has been complicated and time-consuming. Frequently the truck cannot be positioned parallel to the catwalk because the pipe racks are in the way or because of other site logistic problems. Thus the truck must be parked parallel to one end of the catwalk. Additional cranes had to be supplied to lift and position the heavy, cumbersome devices. The devices had protruding portions which had to be completely disassembled and reassembled at the new site. In some instances these problems proved to be too burdensome and the devices were just left at the drilling rig site for the entire drilling cycle requiring separate individual devices for each site.

OBJECTS OF THE INVENTION

Accordingly, it is the principal object of the present invention to provide an improved apparatus for transferring tubular goods between a pipe rack and the floor of a drilling rig, especially for use with onshore rigs.

Another object of the present invention is to provide a pipe handling apparatus having a carriage which moves pipe in a trough wherein the carriage is able to absorb pipe impact forces without damaging the pipe ends or the carriage drive system.

A further object of the present invention is to provide a pipe handling apparatus which can be readily moved to and from a flatbed truck and a catwalk without requiring a crane or similar hoisting machinery.

A still further object of the present invention is to provide a pipe handling apparatus which can be quickly prepared for transport to a new site and rapidly set up for operation there.

Another object is to provide a pipe handling apparatus that has an improved automatic pipe feeder which can absorb pipe impact forces with minimal damage to the feeder chain drive system.

A further object is to provide a pipe handling apparatus which can automatically transfer pipe from the pipe racks to the drilling rig with a short cycle time.

A still further object is to provide a pipe handling apparatus that brings the pipe end close to the center of the drilling rig and at a working level low enough to enable elevators to be used directly for handling the pipe whereby the initial step of handling the pipe with cabel hoists is eliminated.

Another object is to provide a pipe handling apparatus requiring a minimum of additional support equipment at each drilling site.

A further object is to provide a pipe handling apparatus requiring a minimum of manual handling of the pipe as the pipe is moved between the pipe racks and the drilling rig thus eliminating risk of bodily injury and minimizing the need for working crews on the catwalk and pipe racks.

Other objects and advantages of the present invention will become more apparent to those persons having ordinary skill in the art to which the present invention pertains from the following description taken in conjunction with the accompanying drawings.

THE DRAWINGS

FIG. 27 is a side elevational view of an another embodiment of the present invention showing a carriage similar to that of FIG. 26 and further illustrating the chain drive connection.

FIG. 28 is a front elevational view of the carriage of FIG. 27.

FIG. 29 is a side elevational view of the assembly for lifting and lowering the end of the movable trough of FIG. 1.

FIG. 33 is a schematic illustration of the hydraulic system for operating the system of FIG. 29 and the clamps of FIGS. 1 and 32.

DESCRIPTION OF THE INVENTION

General Description

Figure 1:
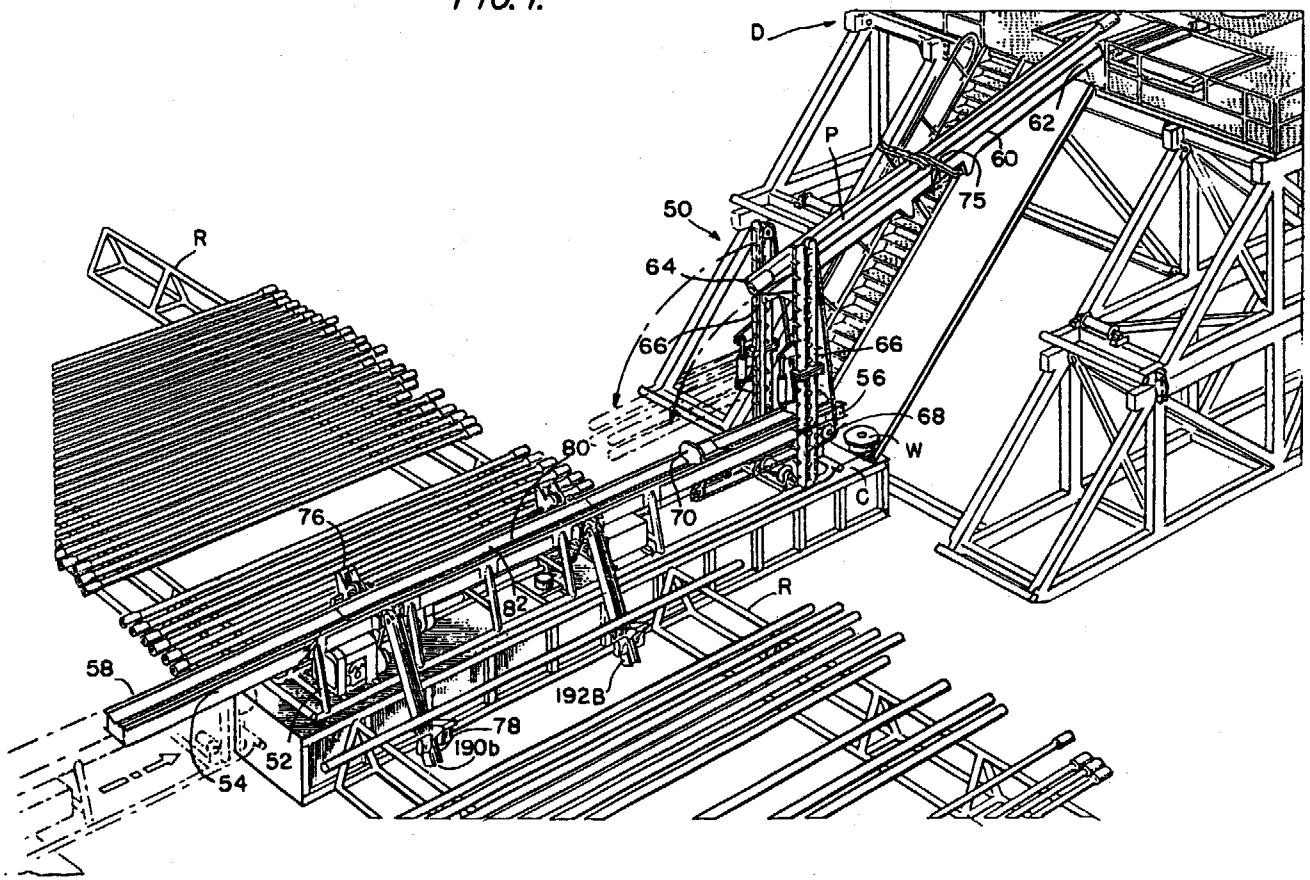
FIG. 1 is a perspective view of an apparatus embodying the present invention in use at a drilling rig site.

The present apparatus includes a stationary trough supported on a frame resting on a catwalk. The catwalk is positioned below and adjacent to a drilling rig platform. A movable trough for transporting pipe is supported on the drilling rig at one end and at the other end is caused to move vertically between a pair of masts. The masts are positioned on opposite sides of the stationary trough that transports pipe to and from the movable trough. When the movable trough is in the "down" position between the masts, the troughs are in operative proximity and pipe may be transferred between the two troughs. A pipe end carriage moves in the stationary trough and pushes pipe onto the movable trough when it is in the "down" position.

In one embodiment, clamps or similar holding devices grasp the pipe in the movable trough and hold it as the movable trough moves between the masts to the "up" position. At this stage hoist cables or equivalent means are connected to the pipe, the clamps are released and the pipe lifted or slid onto the rig. To remove pipe from the rig the pipe is placed on the movable trough when it is in the "up" position and the clamps clamped. The movable trough is moved down to the stationary trough and the clamps released. The pipe is caught by the aforementioned carriage which carefully lowers the pipe onto the stationary trough.

Alternatively, and where it is feasible, the movable trough can be left in the "down" position. The pipe will then be placed in or taken from the inclined trough by hoist cables or similar means. If the clamps are not used when the pipe is slid from the rig floor onto the movable trough when in the "down" position, greater possibly damaging impact forces are exerted on the carriage and on the pipe.

A further embodiment of the present invention includes a bucket arrangement instead of the clamps which supports and moves the pipe along the movable trough. Hoist assemblies on the drilling rig and clamps are no longer needed. The bucket includes a pipe support portion and a series of pairs of arms mounted perpendicularly to the support portion and that open to allow the pipe to travel between the troughs and close to grasp the end of the pipe for movement along the movable trough. The carriage in this embodiment on the stationary trough has pusher arms that push the pipe onto the "open" bucket in the movable trough where it is held by a latch mechanism in the bottom of the movable trough. As the chain drive pulls the bucket up the movable trough the latch mechanism is released and the bucket arms close in one smooth quick operation. The pipe held by the bucket and bucket arms then is pulled to the drilling rig.

Pipe racks are positioned on opposite sides of the stationary trough. Two pair of legs extending on opposite sides of the stationary trough and spaced apart are provided. These legs have pipe cradling lugs on either side that move up and down the legs. A length of pipe is held by the two lugs of the two legs on one side of the apparatus and is moved along the legs and thus between the pipe racks and the stationary trough. Alternatively, the legs themselves may be pivoted between pipe loading and unloading positions. The stationary trough at its pipe loading location includes a dump trough portion that tilts to move pipe between the pipe cradling lugs and the stationary trough.

Detailed Description

Referring to FIG. 1, there is illustrated an apparatus of an embodiment of the present invention shown generally at 50 for handling pipe P and other tubulars. This apparatus generally includes a main support frame 52 shown positioned on a catwalk C, a stationary trough 54 having ends 56 and 58 mounted on and supported by support frame 52, and a movable trough 60 supported at one end 62 on drilling rig D and at the other end 64 by a pair of masts 66, 66. Masts 66, 66 are mounted on opposite sides of stationary trough end 56. A mast drive system shown generally at 68 causes movable trough end 64 to move vertically between masts 66, 66. When end 64 is in a "down" position, stationary trough 54 and movable trough 60 are in operable proximity so that pipe P may slide from one trough to the other.

Figure 30:
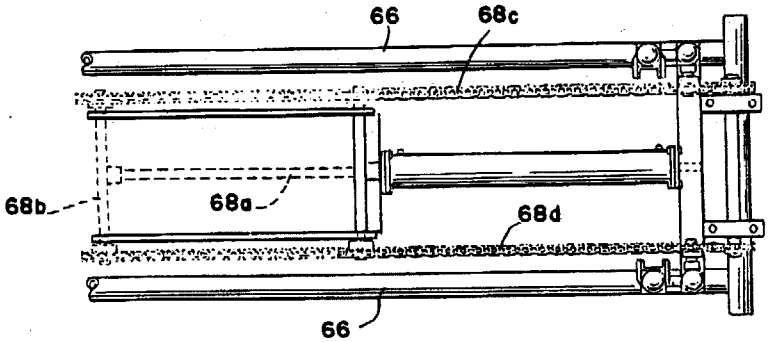
FIG. 30 is a bottom plan view of the system of FIG. 29.
Figure 31:
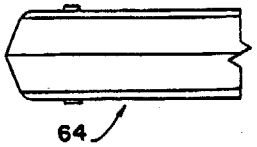
FIG. 31 is a top plan view of the lower end of the movable trough of FIG. 1.

The operation of the mast drive system, as best shown in FIGS. 29 and 30, includes a hydraulically actuated cylinder assembly whose rod 68*a* pushes a cross-bar 68*b* up and down between masts 66, 66. Cross-bar 68*b* pulls chains 68*c* and 68*d* as rod 68*a* is extended and these chains are attached to end 64 of movable trough 60. Further details are found in commonly-owned U.S. application Ser. No. 192,495, filed Sept. 30, 1980, now U.S. Pat. No. 4,371,302, corresponding PCT application, Ser. No. 81/01322 filed Sept. 30, 1981, which disclosures are hereby incorporated in their entirety. As end 64 is moved vertically up, movable trough end 62 is slid further onto drilling rig D whereby the pipe will be positioned closer to the center of the rig and at a lower, more accessible, working level. Referring to FIG. 33, the hydraulic system shown generally at 69 for operating the cylinder assembly comprises an oil reservoir 69*a*, a pump 69*b*, a four way directional control valve 69*c* and appropriate flow lines.

Figure 3:
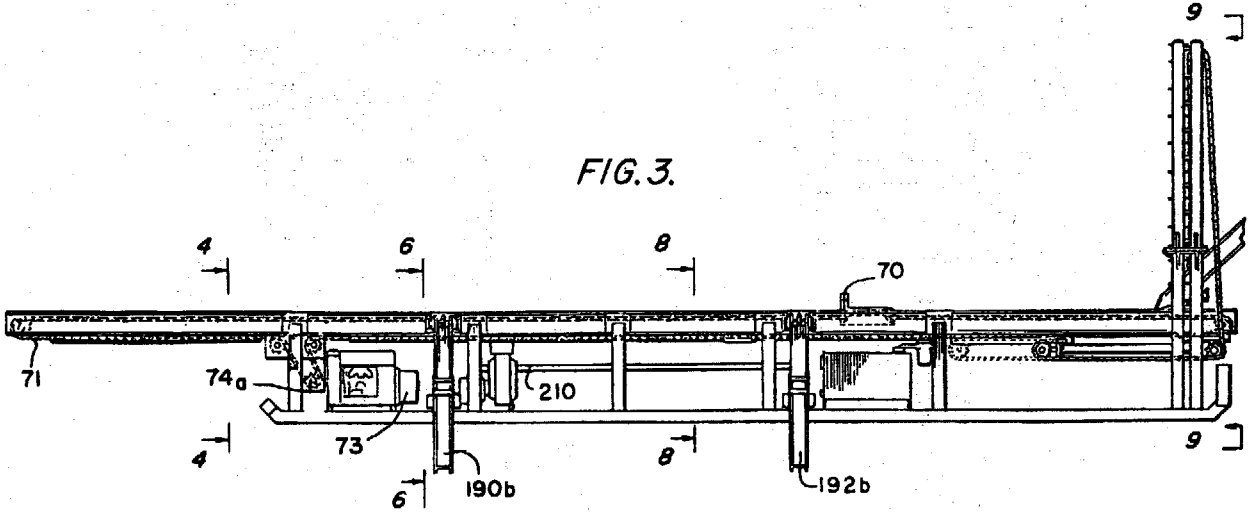
FIG. 3 is a side elevational view of the stationary trough of FIG. 2.
Figure 4:
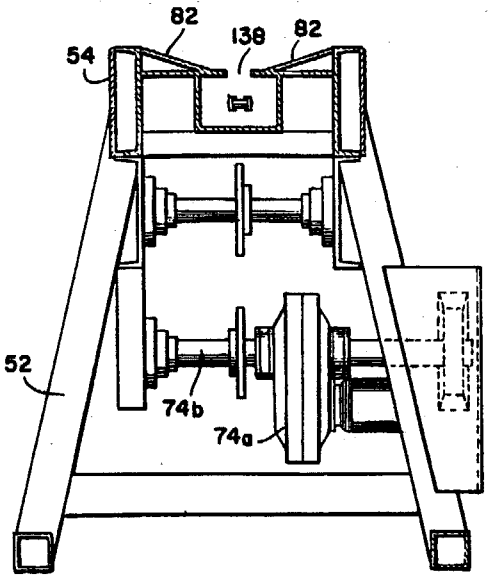
FIG. 4 is a cross-sectional view taken along line 4—4 in FIG. 3.
Figure 5:
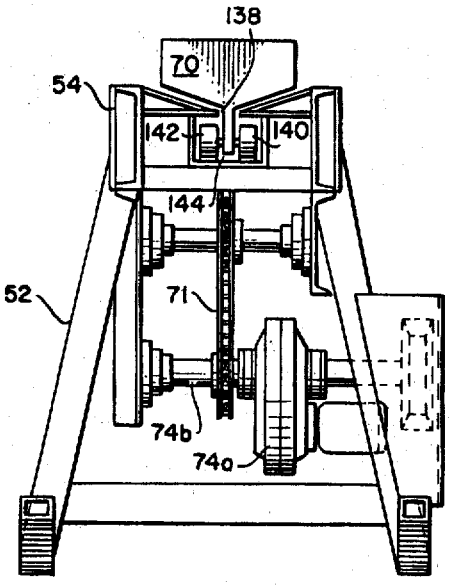
FIG. 5 is a view similar to that of FIG. 4 further illustrating the carriage and chain drive.
Figure 6:
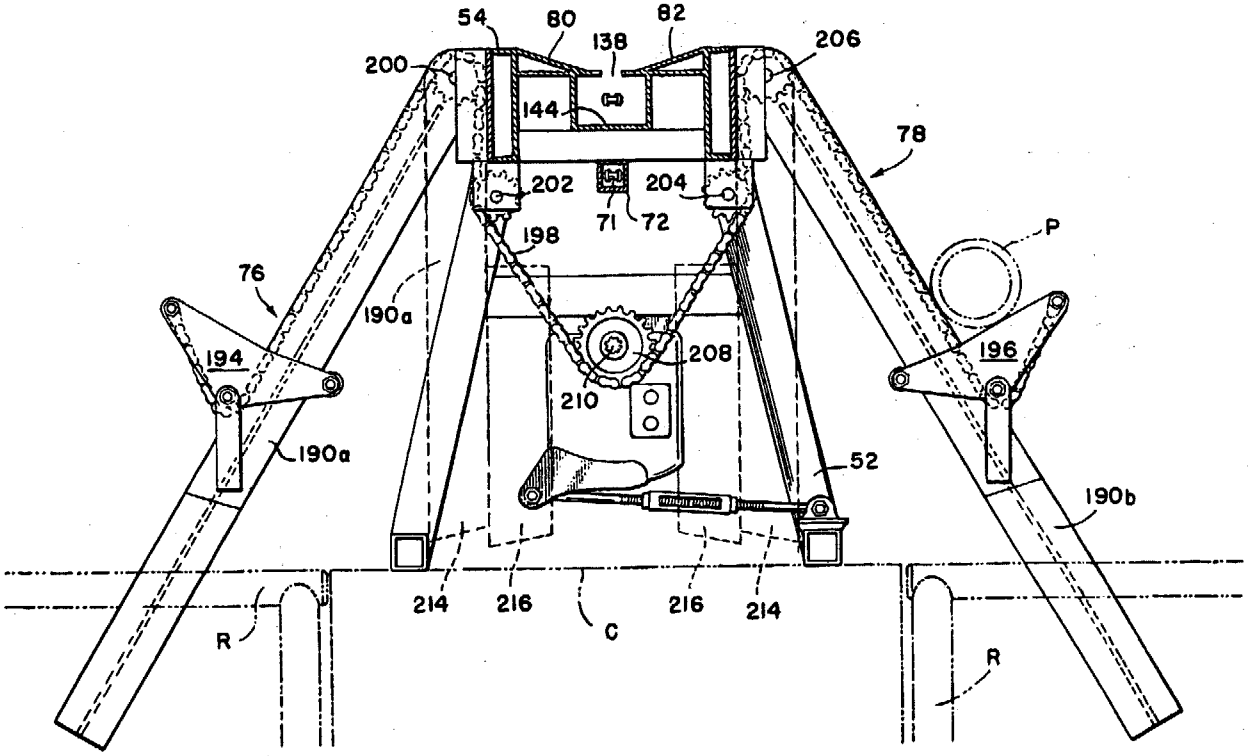
FIG. 6 is a cross-sectional view taken along line 6—6 in FIG. 3; the legs are shown in phantom lines in their folded position.
Figure 10:
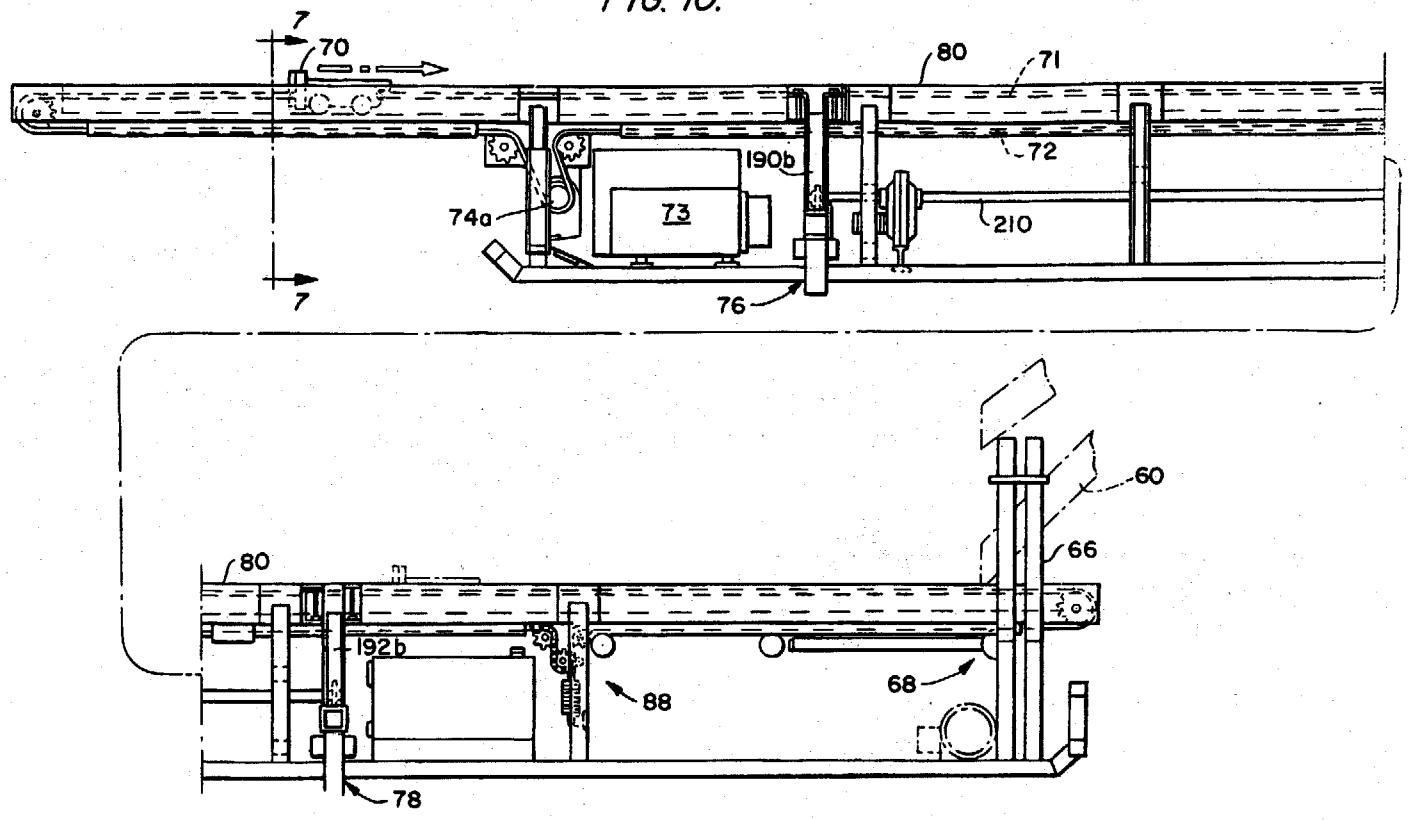
FIG. 10 is a side elevational view of the stationary trough similar to that of FIG. 3 further illustrating the position of the chain drive shock absorber and the carriage of FIG. 22.

The invention further includes a carriage 70 positioned in stationary trough 54 which grasps one end of pipe P and pushes the other end onto movable trough 60 when in the lowered position. The carriage also catches the pipe as it slides down movable trough 60 and then controls the movement of the pipe down into stationary trough 54. Thus carriage 70 driven by a carriage drive system slides along the length of the trough, as best shown in FIGS. 3, 6 and 10, moving pipe P along with it. The carriage drive system includes an endless chain 71 attached to carriage 70 at opposite ends thereof. Chain 71 runs in chain tube 72 around a series of sprockets and is driven by a motor 73 having a hydraulically-driven reducer 74*a* and drive shaft 74*b*, as illustrated in FIGS. 4 and 5. Further disclosure details relating to the drive system are found in the previously-mentioned applications.

Figure 32:
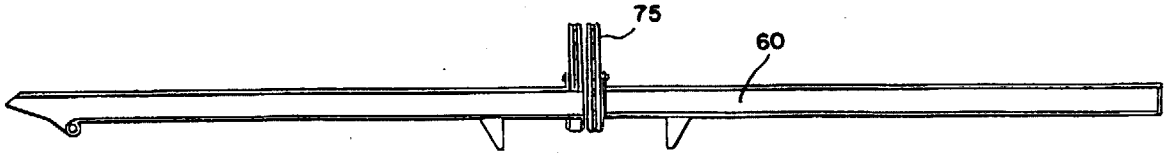
FIG. 32 is a side elevational view of the movable trough of FIG. 1 illustrating the clamping device.

Clamps 75, as shown in FIGS. 1 and 32, firmly hold pipe P in movable trough 60 as it moves up and down between the masts and then release the pipe so that it may be transferred either to stationary trough 54 or drilling rig D. Clamps 75 comprise a pair of hydraulically actuated arms pivotally attached on opposite sides of the movable trough as shown in FIGS. 1 and 32 and in commonly-owned U.S. patent application Ser. No. 192,477, filed Sept. 30, 1980, now U.S. Pat. No. 4,382,591, whose contents are hereby incorporated in their entirety, as well as in the previously-incorporated PCT application. An appropriate hydraulic circuit for the arms is shown generally at 75*a* and 75*b* in FIG. 33.

Figure 2:
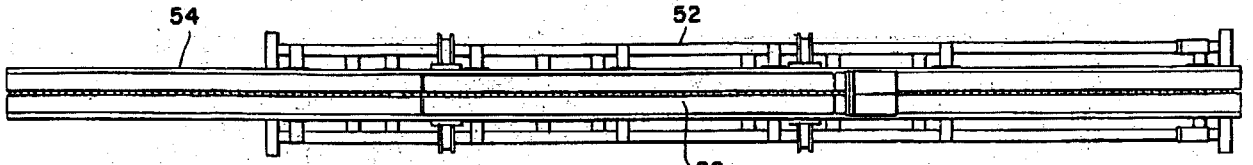
FIG. 2 is a top plan view of the stationary trough of FIG. 1.
Figure 8:
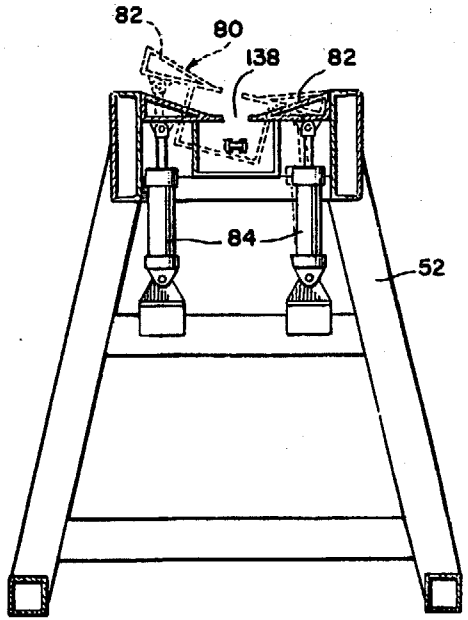
FIG. 8 is a cross-sectional view taken along line 8—8 in FIG. 3; the dump trough portion is shown in phantom lines in its tilted position.

Pipe racks R, R are positioned on either side of catwalk C and as shown in FIGS. 1 and 6 comprise a pair of elongagted triangular-shaped structures. However, any suitable pipe racks may be used. Pipe loading mechanisms 76 and 78, located on opposite sides of the stationary trough, lift and lower the pipe between pipe racks R, R and stationary trough 54. Stationary trough 54 includes a dump trough portion 80 in a middle section of the stationary trough which tilts to load and unload pipe, as best shown in FIGS. 2 and 8. The inclined pipe engaging surfaces 82, 82 are caused to tilt by the actuating of two pair of pivotally-mounted, hydraulically-actuated cylinder assemblies, one pair 84 of which is shown in FIG. 8 positioned at opposite ends of dump trough portion 80. This is more fully described in the previously mentioned and incorporated U.S. and PCT applications.

Pipe P, as earlier explained, slides down movable trough 60 into stationary trough 54 where it impacts and is held by carriage 70. The present invention provides for a shock absorbing system shown generally at 88 in FIGS. 10 and 20 to 23 to absorb these forces.

Figure 20:
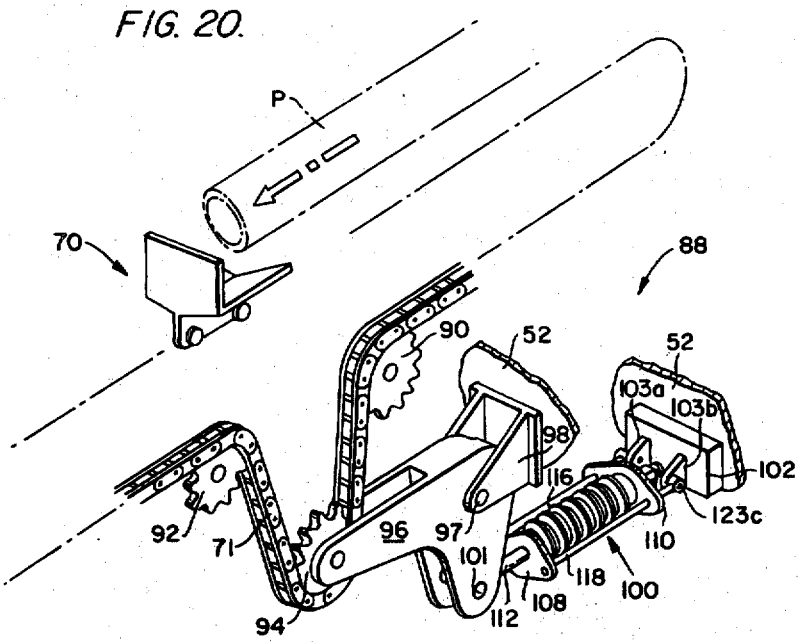
FIG. 20 is a fragmentary perspective view of the carriage drive assembly of FIG. 1.
Figure 21:
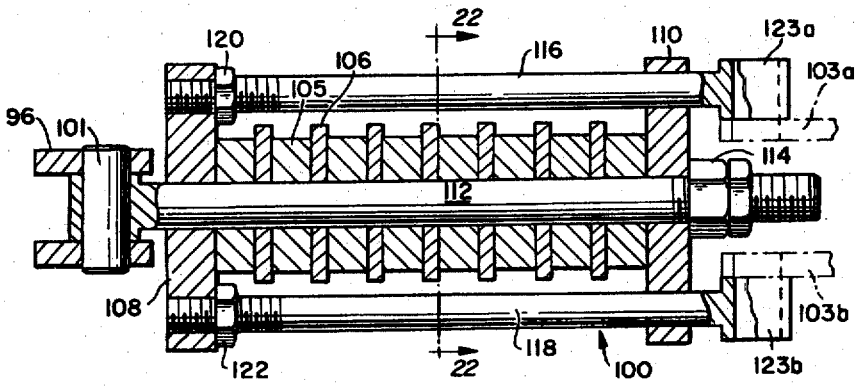
FIG. 21 is a top plan view of the shock absorber of the assembly of FIG. 20.
Figure 22:
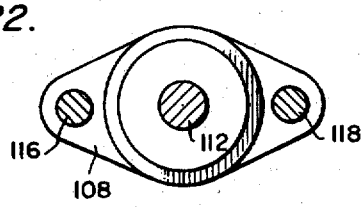
FIG. 22 is a cross-sectional view taken along line 22—22 of FIG. 21.

As best shown in FIG. 20, a first embodiment of system 88 includes fore and aft sprockets, 90 and 92, over which endless chain 71 rides. A third sprocket 94 is positioned between and beneath the fore and aft sprockets and the chain engages the lower portion of the third sprocket. Third sprocket 94 is rotatably attached to one end of a bell crank 96. Bell crank 96 is pivotally attached at its fulcrum point 97 to a bracket 98 mounted on main support frame 52. A shock absorber 100, as best shown in FIGS. 21 and 22, is pivotally connected at one end by a pin 101 to the second end of bell crank 96. Shock absorber 100 is pivotally connected at its second end to a shock absorber bracket 102 with ears 103*a* and 103*b* which is mounted on main support frame 52 as best shown in FIG. 20.

Referring to FIGS. 21 and 22 the details of the shock absorber are illustrated. Shock absorber 100 generally includes a series of alternating rubber 105 and metal 106 donut shaped portions with metal plates 108 and 110 at each end. Bell crank connecting rod 112 is slidably positioned through holes in plates 108 and 110 and through the donut shaped portions and is secured by nut 114. Bracket rods 116 and 118 pass through both of the plates from the opposite direction as crank connecting rod 112 and are secured at one end each by nuts 120 and 122 respectively. The nuts can be turned to obtain the desired shock absorber elasticity. At the other ends, the bracket rods 116 and 118 are slidable in plate 110 and are formed with enlargements having bores 123*a* and 123*b* that are pivotally secured to their respective ears 103*a* and 103*b* by pins 123*c*, as shown in FIG. 20.

Thus as pipe P impacts the carriage, the chain is jolted putting upward forces on the third sprocket. Bell crank 96 is pivoted about its fulcrum 97 causing the second end to pivot out, i.e., away from the shock absorber. As best shown in FIG. 21 the plates are thereby forced together. The amount of shock absorbed, i.e., the amount the plates compress, is dependent upon the elastic properties of the alternating rubber segments 105 and the amount they have been prestressed by plates 108 and 110 through their adjustable nuts 120 and 122.

Figure 23:
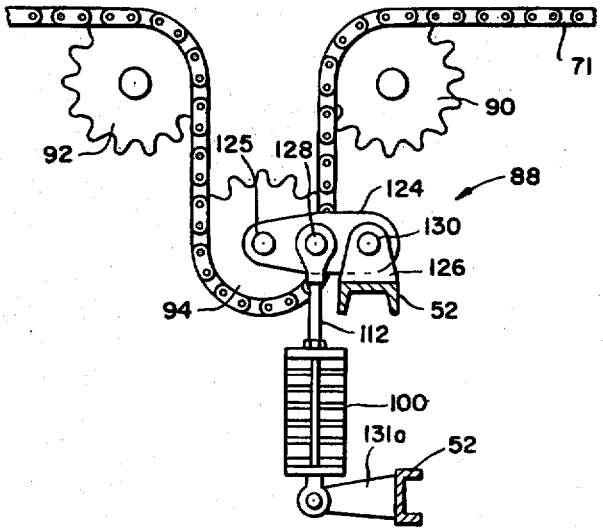
FIG. 23 is a side elevational view of a preferred embodiment of the carriage shock absorber assembly of FIG. 20.

FIG. 23 shows a second embodiment of shock absorbing system 88. A link member 124 is used instead of bell crank 96 as previously described. Link member 124 has one end rotatably connected at 125 to the third sprocket 94 and is pivotally connected at the second end at 130 to mounting plate 126 secured to main support frame 52. Shock absorber 100 is disposed in a generally vertical position to enable connecting rod 112 to be pivotally connected at 128 to a middle section of link member 124 and pivotally mounted at the other end at 131 to extension plate 131*a* secured to main support frame 52. Thus when the pipe impacts the carriage, the chain forces the third sprocket upwardly. Link member 124 rotates clockwise about mounting plate 126 pulling the connecting rod 112 of the shock absorber upwardly. The shock absorber, as previously described, then dampens these impact forces.

Figure 24:
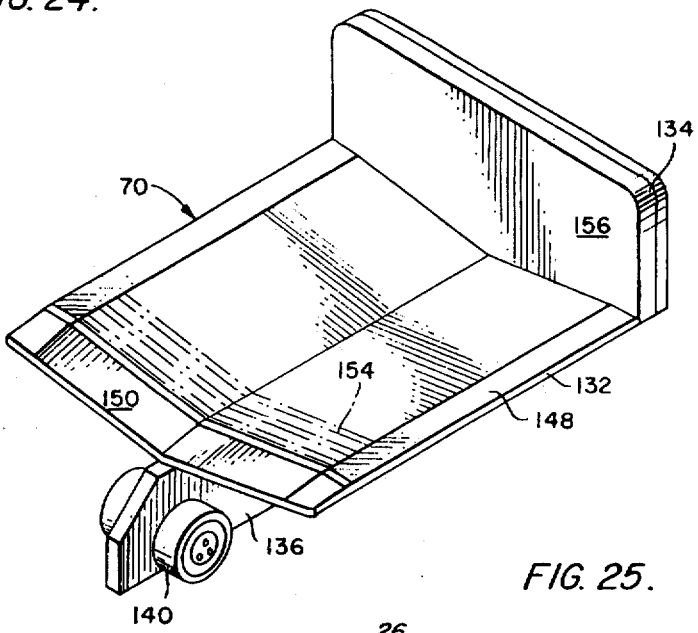
FIG. 24 is an enlarged perspective view of the carriage of FIG. 20.
Figure 25:
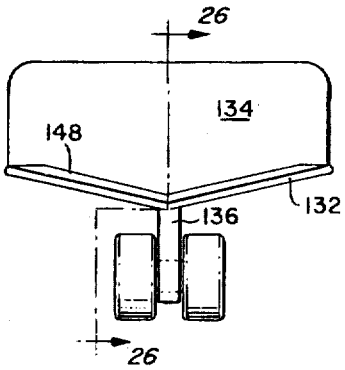
FIG. 25 is a front plan view of the carriage of FIG. 24.
Figure 26:
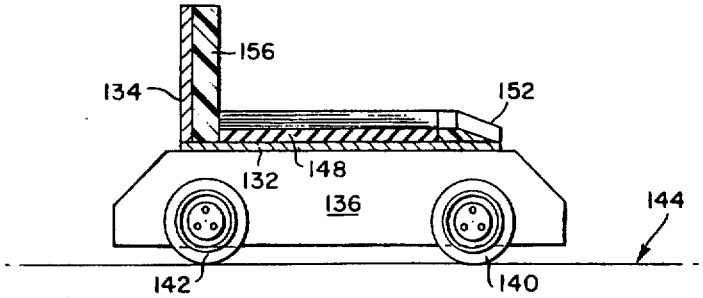
FIG. 26 is a partial cross-sectional view taken along line 26—26 of FIG. 25.

Referring to FIGS. 24–26, carriage 70 generally includes a floor 132, a vertical striker plate 134, and a depending spine 136 which is attached to the underside of the floor along its centerline. As shown in FIG. 5, the carriage 70 is located with spine 136 positioned in the elongated slot 138 of stationary trough 54 with two pair of wheels 140 and 142 rotatably mounted to spine 136 and depending below slot 138. The wheels are so positioned that they run the length of slot 138 in a channel 144 attached to support frame 52 below stationary trough 54. The wheels are conventional self-lubricating, sealed-bearing wheels. Floor 132 of the carriage includes two metal plates welded in a flattened V shape whereby the carriage conforms to and can travel in the stationary trough. A layer of die rubber 148 is placed on floor 132 to frictionally control pipe P as it slides onto carriage 70 and to absorb vertical forces exerted on floor 132. A layer 150 of abrasion resistant material such as "Delrin", a linear polyoxymethylene type acetal resin, is fastened to the forward edge of the floor. Layer 150 is wedge-shaped forming a ramp-like surface 152 so that the pipe can easily slide onto floor 132. To further slow the pipe as it slides onto the carriage a series of cuts 154 are made in the rubber surface adjacent layer 150. Vertical striker plate 134 also has a layer 156 of the same material as layer 150 attached to it to protect the threaded ends of the pipes as they impact the plate. A further design for the carriage is shown in FIGS. 27 and 28 which further illustrates the connection of endless chain 71 to carriage 70. This design omits the use of wheels 140, 142 and simply enlarge the spine 136 as at 157 for sliding movement within channel 144.

Figure 34:
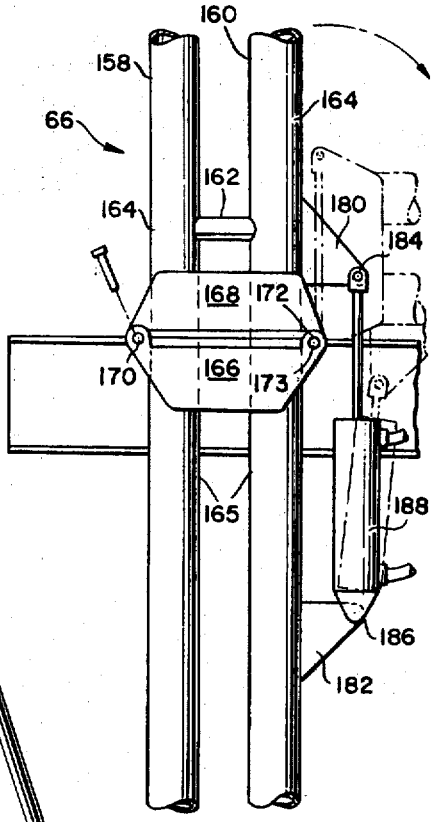
FIG. 34 is a side plan view of the vertical mast of FIG. 29 illustrating a preferred embodiment wherein the upper portion of the mast can be folded level with the stationary trough of FIG. 2.

As an alternate embodiment to the mast 66,66 shown in FIG. 29, FIG. 34 illustrates a folding capability for these masts. Referring to FIG. 34, each mast 66 includes two parallel tubular members 158 and 160 mounted on support frame 52 and having connecting members 162. Each of the masts are severed at the level of the upper edge of stationary trough 54 forming upper portions 164 and lower portions 165 so that they may be easily disassembled for transport. Lower connecting plate 166 is mounted on the outside of the masts below the juncture of the upper and lower portions 164, 165 and upper connecting plate 168 is mounted above the juncture. A similar pair of plates is mounted on the inside of the masts. Each of the plates 166 and 168 has a pair of eyelets 170 and 172 which registers with the adjoining plate's eyelets. A hinge pin 173 passes through eyelets 172 allowing the masts to be folded parallel with the stationary trough. When the masts are vertical a locking pin 176 is inserted through eyelets 170 and a cotter pin inserted in the locking pin to hold the locking pin in place. The cotter pins and then the connecting pins are removed when upper mast portions 164 are to be folded down.

Brackets 180 and 182 are mounted on the upper and lower portions respectively of mast 66, 66 as shown in FIG. 34. Brackets 180 and 182 have a pad eye, 184 and 186 respectively, through which opposite ends of hydraulic cylinder 188 are pivotally mounted. Thus, as the phantom lines in FIG. 34 show, the upper mast portions are brought to a folded position about pin 173 when the cylinder is retracted and are brought to a vertical position when the piston is extended.

Figure 7:
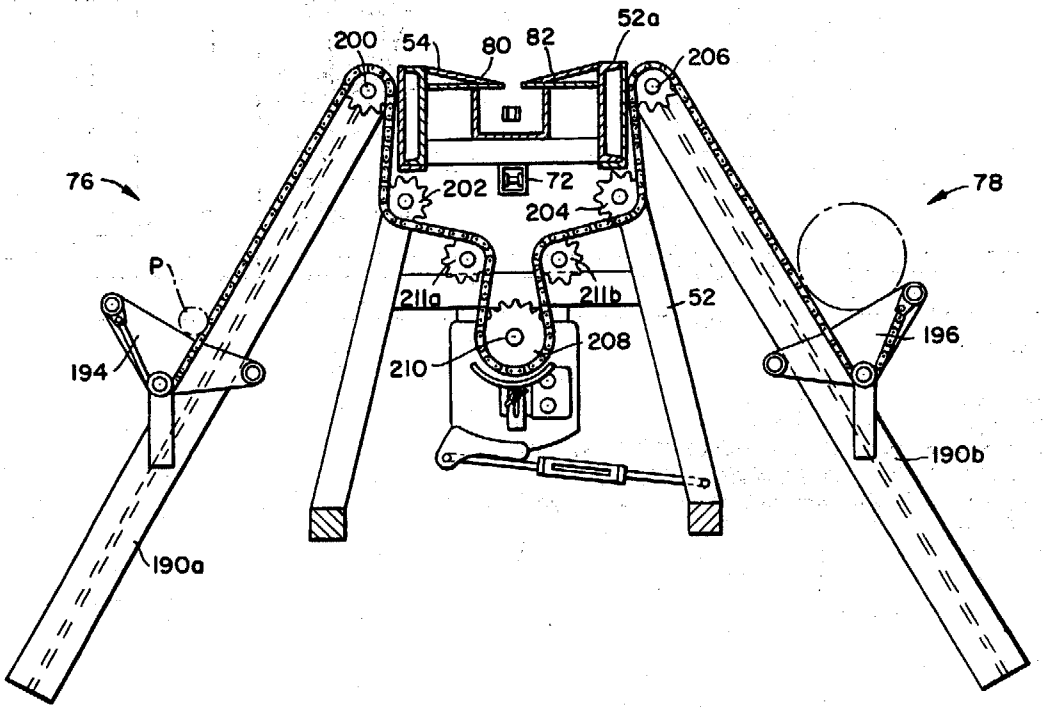
FIG. 7 is a view similar to that of FIG. 6 illustrating another embodiment of the present invention taken along line 7—7 of FIG. 10.
Figure 13:
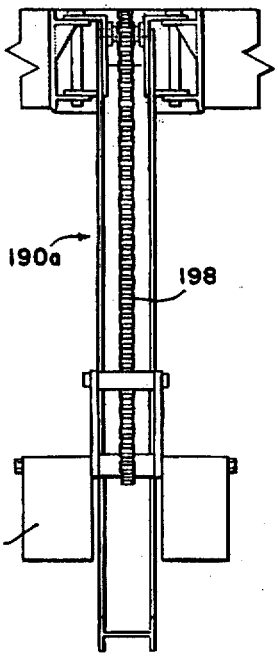
FIG. 13 is a side elevational view of one of the legs of FIG. 1.
Figure 9:
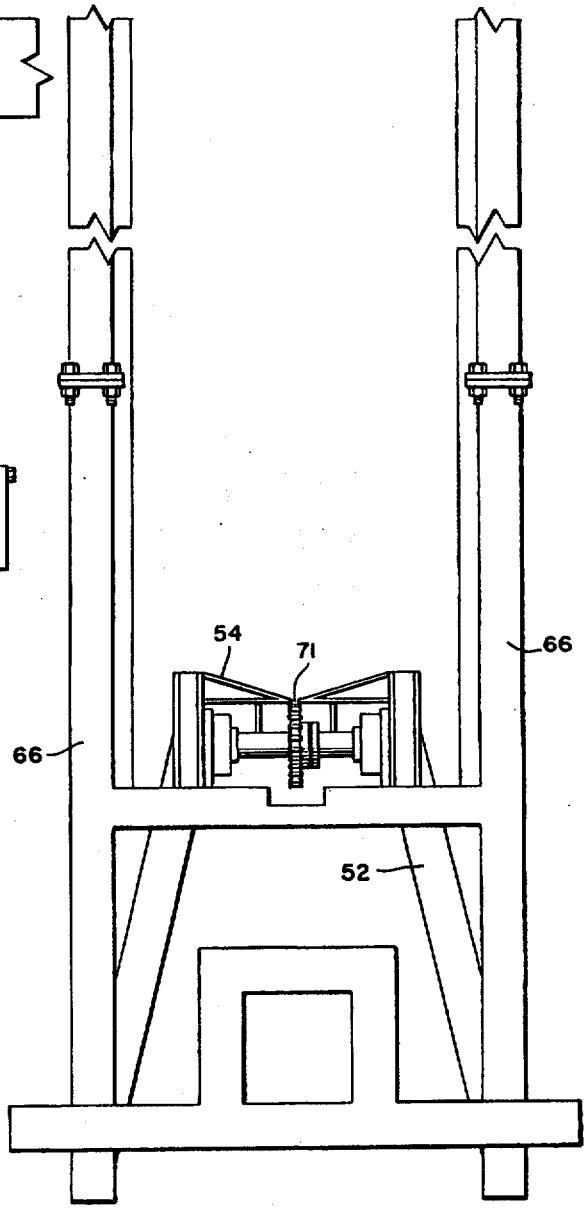
FIG. 9 is an end elevational view as seen from line 9—9 in FIG. 3.

Pipe loading mechanisms 76 and 78 as best shown in FIGS. 1, 6 and 7 include two pair of legs 190*a* and 190*b* and 192*a* and 192*b*. Each leg has a pipe cradling lug as best shown in FIG. 6 at 194 and 196 for legs 190*a* and 190*b* respectively. The lugs on opposing legs are connected by a single drive chain 198. So as one lug travels up its associated leg, the other lug travels down its leg. The chain travels over idler sprockets 200, 202, 204 and 206 and is driven by drive sprockets 208. Drive sprocket 208 is driven by drive shaft 210.

As best shown in FIGS. 3 and 10, drive shaft 210 also drives the lugs on legs 192*a* and 192*b*. The legs are spaced so that the lugs can grasp opposite ends of a length of pipe P. The lugs are spaced and timed so that they carry pipe in a level even manner.

As the pipe impacts the lugs the chain can "jump" sprockets of the invention of FIG. 6 and thus the lugs can become misaligned. The pipe then tends to slide off the lugs or not be deposited properly on either the pipe rack or the stationary trough. Thus, the alternate embodiment of FIG. 7 includes idler sprockets 211*a* and 211*b* mounted on main support frame 52 which provide additional sprocket-chain contact preventing the chain from "jumping".

Figures 11, 12:
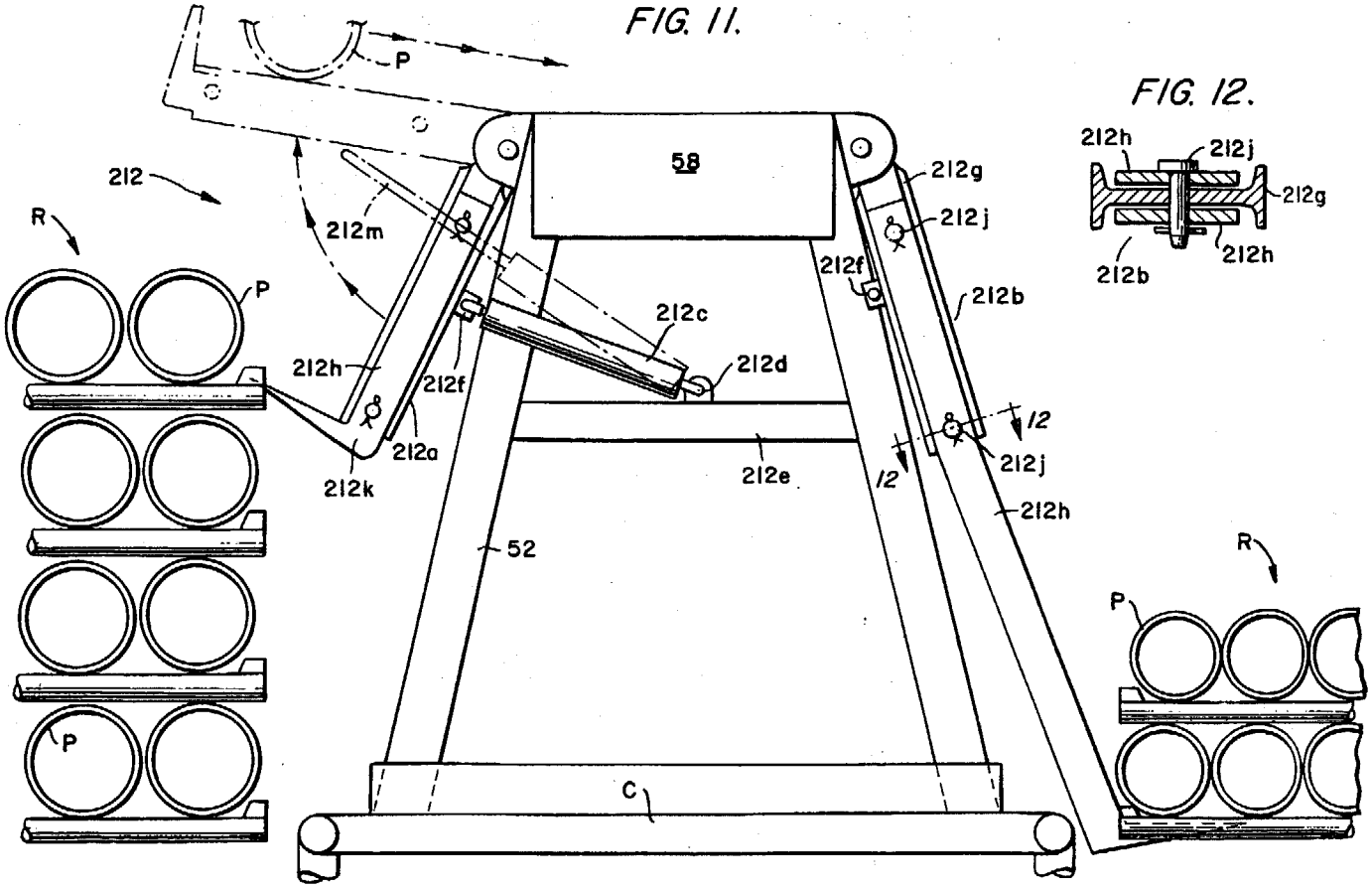
FIG. 11 is a view similar to that of FIG. 6 illustrating another embodiment of the present invention shown in relation to the pipe racks of FIG. 1; the legs are shown in phantom lines in their upper position.
FIG. 12 is a cross-sectional view taken along line 12—12 in FIG. 11.
Figure 14:
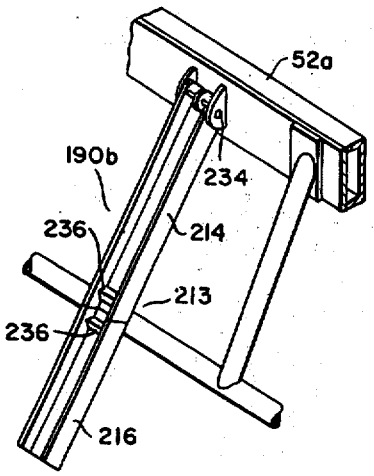
FIG. 14 is a fragmentary perspective view of one of the legs of FIG. 1 showing the leg in the extended position.
Figure 15:
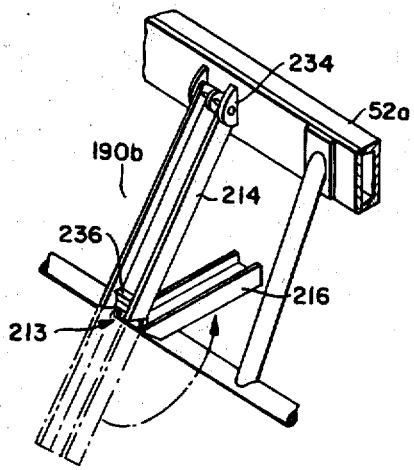
FIG. 15 is a fragmentary view similar to that of FIG. 14 showing the leg being folded.
Figure 16:
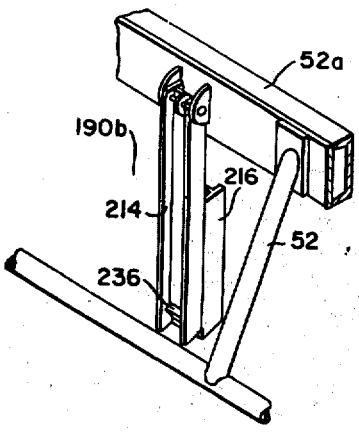
FIG. 16 is a fragmentary view similar to that of FIG. 14 showing the leg in the folded position.
Figure 17:
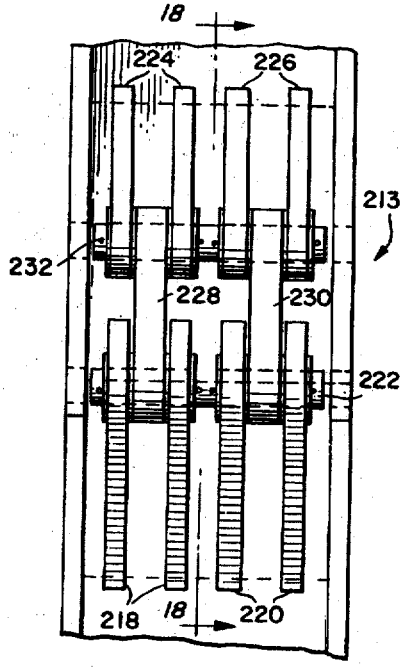
FIG. 17 is a fragmentary rear elevational view of the hinge assembly portion of the leg of FIG. 14.
Figure 19:
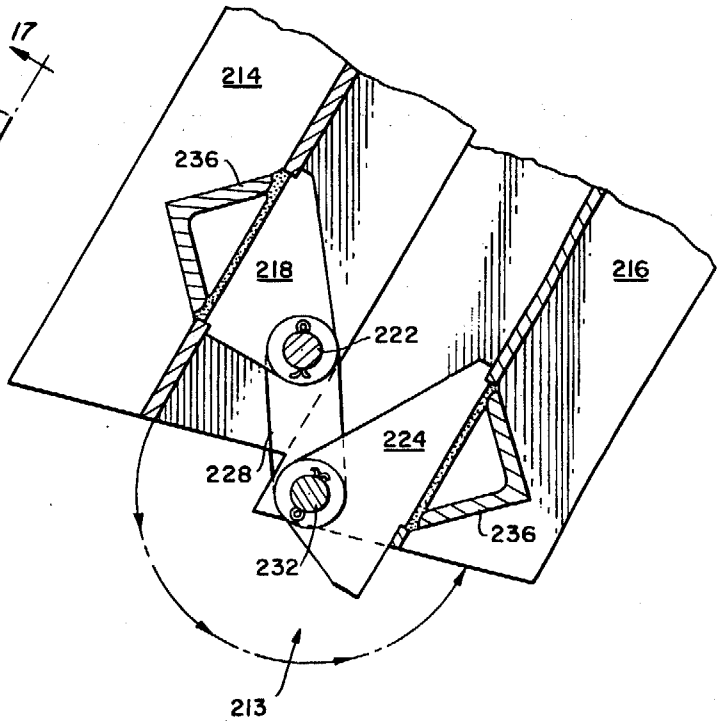
FIG. 19 is a cross-sectional view similar to that of FIG. 18 showing the hinge assembly when the leg is in the folded position.
Figure 18:
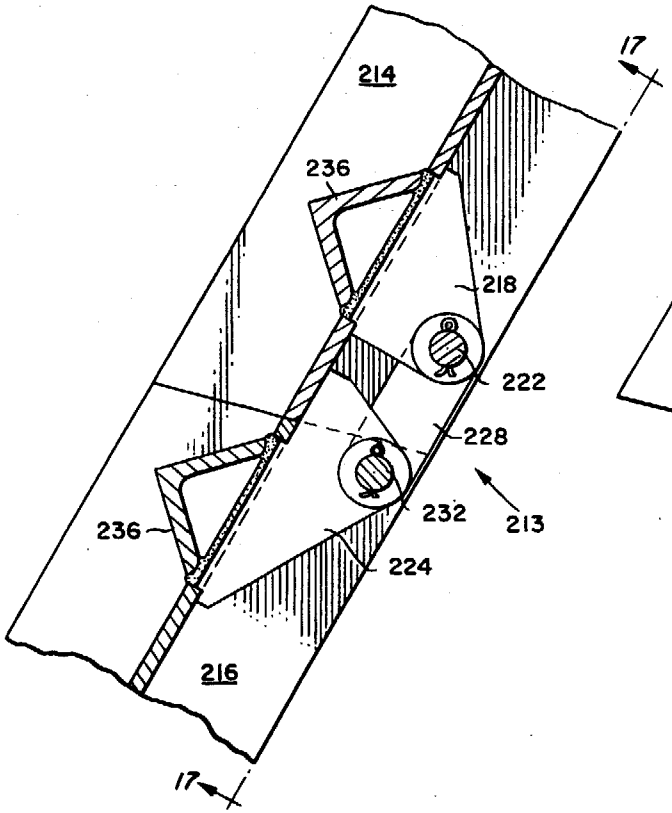
FIG. 18 is a cross-sectional view taken along line 18—18 of FIG. 17.

FIG. 11 illustrates another embodiment of the present invention shown generally at 212. A pair of arms 212*a* and 112*b* are pivotally connected to main support frame 52. A hydraulic cylinder 212*c* is pivotally secured at one end to an ear 212*d* secured to the horizontal frame member 212*e* forming a part of main support frame 52 and at the other end to ear 212*f* of arm 212*a*.

As best shown in FIGS. 11 and 12 each arm 212*a* and 212*b* comprises an I-beam shaped member 212*g* pivotally secured to the frame and a two piece bar extension 212*h*, 212*h* positioned on opposite sides of the flange portion of the I-beam. The bar extensions 212*h*, 212*h* are secured to the I-beam by pins 212*j* or bolts or other similar removable means. The present invention includes the use of different lengths of bar extensions 212*h* for the arms so that the arms may engage pipe P at different levels of pipe rack R. The bar extensions 212*h* include a transversely angled foot 212*k* which allows the pipe to be cradled as it travels between its lower and its upper positions (as shown in phantom lines in FIG. 11). As the hydraulic cylinder is actuated and the cylinder rod 212*m* is extended the arm is caused to pivot to its upper position. The present invention also contemplates disconnecting the hydraulic cylinder from ear 212*f* on arm 212*a* and connecting it to an ear 212*f* on the other arm 212*b* in order to transfer pipe on the pipe rack on the opposite side of frame 52. It is also within the scope of the present invention to provide a second hydraulic cylinder (not shown) to be permanently attached to the arm 212*b* in the manner described for arm 212*a*. Instead of the coupling of the different length extensions, an arm having length-telescoping features (not shown) can be used.

The present invention also provides for a mechanism for folding the pivotally attached legs up against the apparatus for easier transport, as shown in phantom lines in FIG. 6. The hinge mechanism shown generally at 213 for connecting the upper and lower leg portions 214 and 216 is best shown in FIGS. 14–19. Two pair of hinge plates 218 and 220 are mounted to the upper end of the lower leg portion 216. Each of the plates has holes that are in alignment and through which a shaft 222 is inserted. A similar structure is found on the adjoining end of the upper leg using hinge plates 224 and 226. Links 228 and 230 having openings at opposite ends are positioned between each of the pairs of hinge plates and shafts 222 and 232 pass through the holes whereby the links may rotate about the shafts. Appropriate hinge pins and washers hold the plates around the links providing a sandwich action to prevent the links from sliding along the shafts. The leg 190*b* may then fold back about the pivotal attachment at 234 to crossbar 52*a* of main support frame 52. Braces 236, 236 are mounted transversely on the legs to provide additional structural support for the legs.

Figure 35:
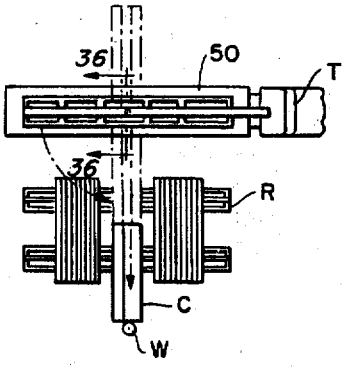
FIG. 35 is a top plan view of the apparatus of FIG. 1 illustrating the pivotal and dragging movement of the apparatus onto and off of a vehicle flatbed positioned adjacent the apparatus.
Figure 36:
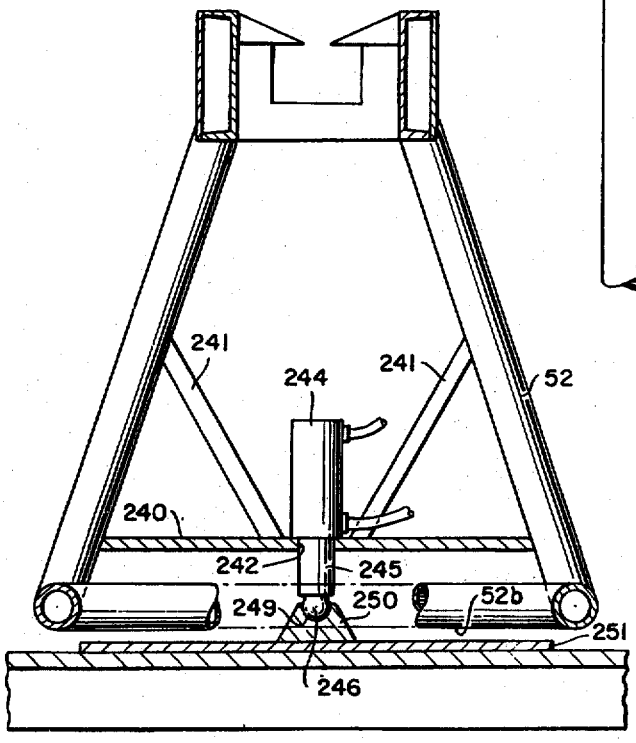
FIG. 36 is an enlarged cross-sectional view taken along line 36—36 of FIG. 35.

The lifting and pivoting assembly 238 is best shown in FIGS. 35 and 36. A horizontal support plate 240 is secured to support frame 52, with angled braces 241 being provided therefor between frame 52 and support plate 240 which is spaced a vertical distance above the bottom 52*b* of support frame 52. A hydraulic cylinder 244 is securely mounted on top of support plate 240 and has its rod 245 pass through a hole 242 in support plate 240. The end of the rod 245 is shaped in the form of a ball 246 that is rotatably held in a socket 249 in support foot 250. Foot 250 is welded to a lift plate 251 having a substantial surface area sufficient to spread the weight of the apparatus being supported.

Thus, as best shown in FIG. 35, a flatbed truck T carrying the pipe handling apparatus 50 is driven up to the drilling rig site but because of the prepositioned pipe racks R and catwalk C and other site logistics the truck must be parked perpendicular to the catwalk. Hydraulic cylinder 244 is activated and rod 245 is extended pushing against lift plate 251 thereby raising apparatus 50. So that the apparatus may be lifted entirely without tilting, the cylinder 244 and lift plate 240 should be located at the longitudinal center of gravity of the apparatus.

Once in the lifted position on truck T, apparatus 50 is pivoted about ball 246 until it is in alignment with catwalk C. Rod 245 is then retracted and the apparatus lowered to again be supported by frame bottom 52*b* resting on the truck T. Thereafter, winch cables are attached to the support frame and a winch W positioned at the drilling rig end of catwalk C is operated whereby the apparatus is dragged onto the catwalk. A similar procedure with a winch (not shown) mounted on truck T can drag the apparatus back onto the truck. The rod extended, the apparatus lifted and pivoted into position on the flatbed of the truck, and the rod retracted in order to lower the apparatus on the flatbed. The support frame may include skids or other suitable structure to aid in the dragging operation.

Figure 38:
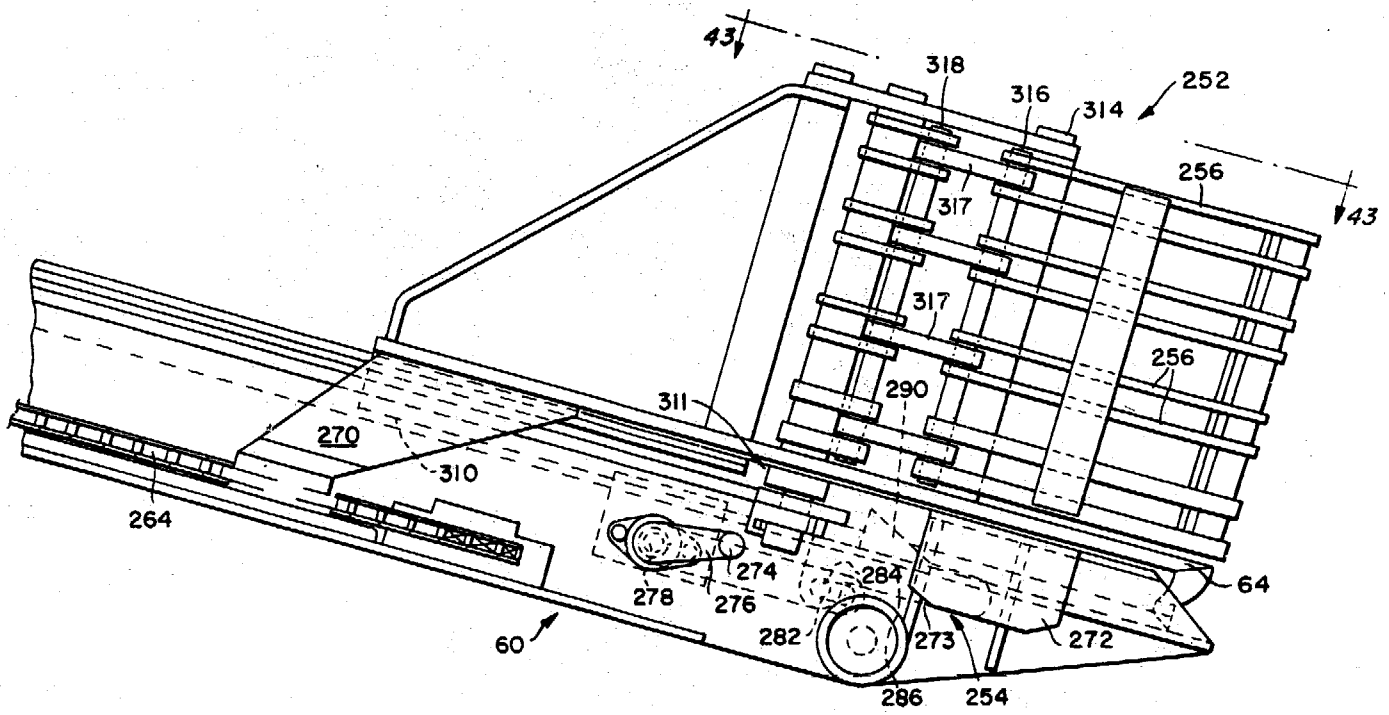
FIG. 38 is a side elevational view of the lower end of the movable trough of FIG. 37 illustrating the bucket arms in the open position.
Figure 39:
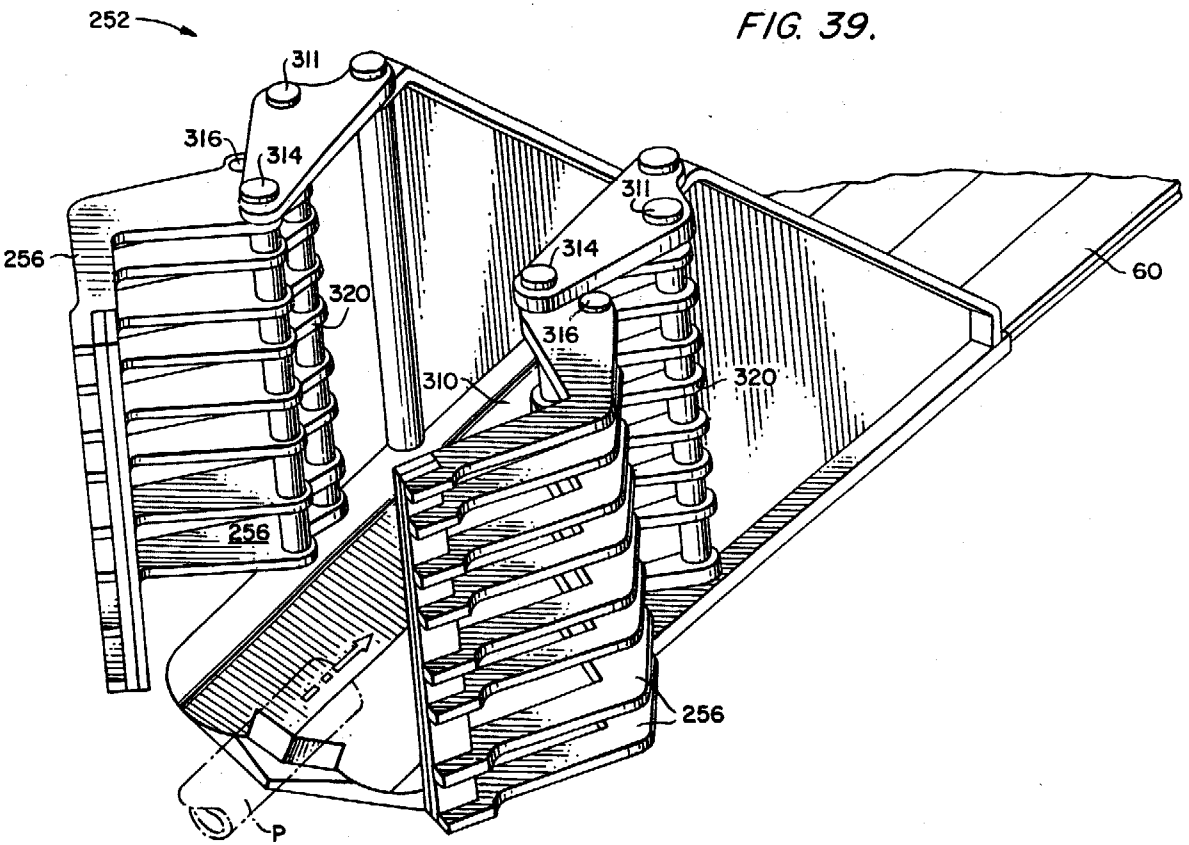
FIG. 39 is a perspective view of the superstructure of the bucket assembly of FIG. 38.
Figure 40:
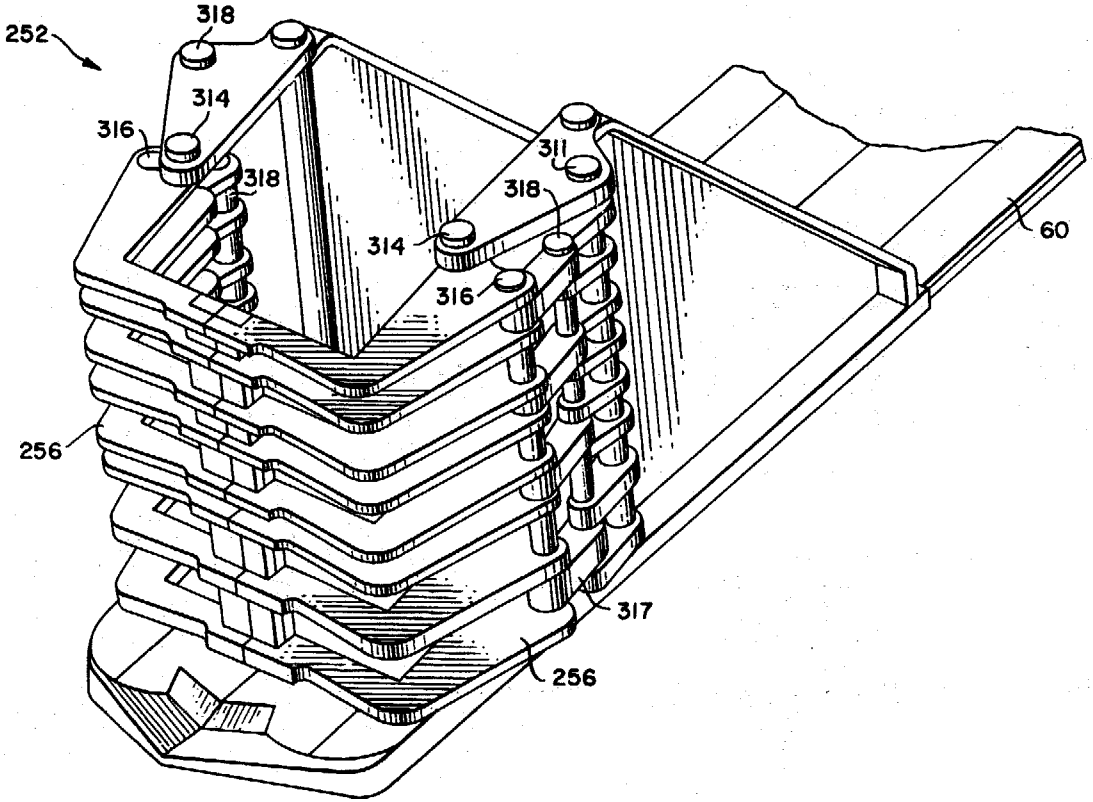
FIG. 40 is a perspective view similar to that of FIG. 39 illustrating the bucket arms in the closed position.
Figure 41:
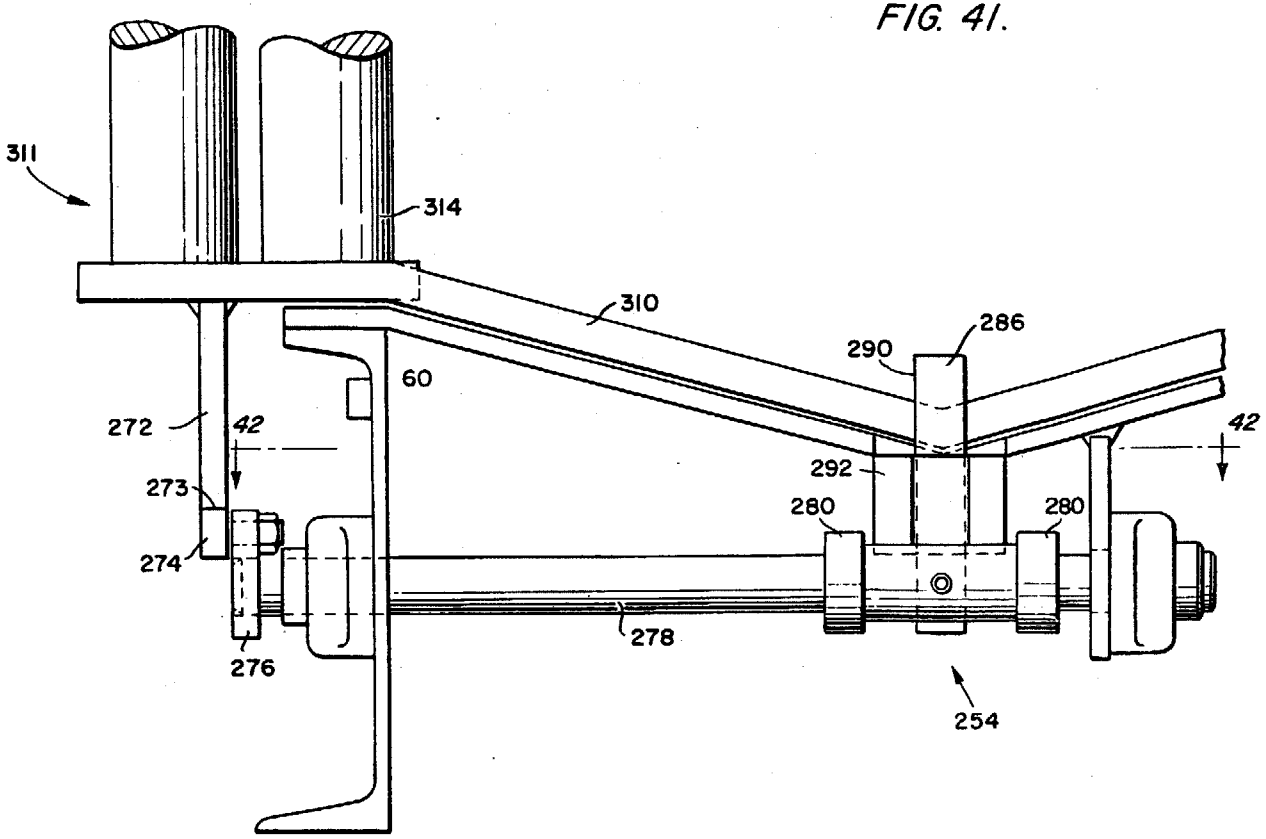
FIG. 41 is a fragmentary end elevational view of the latching mechanism of the movable trough of FIG. 38.
Figure 42:
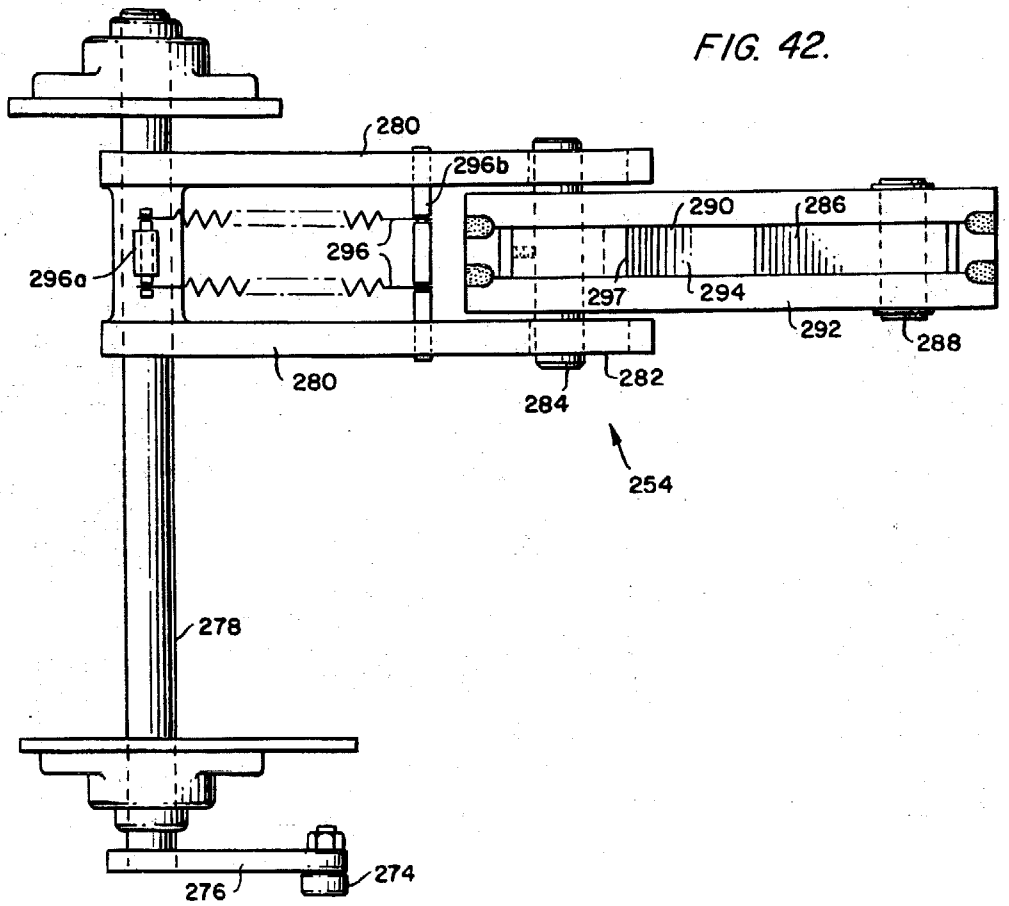
FIG. 42 is a cross-sectional view taken along line 42—42 in FIG. 41.
Figure 45:
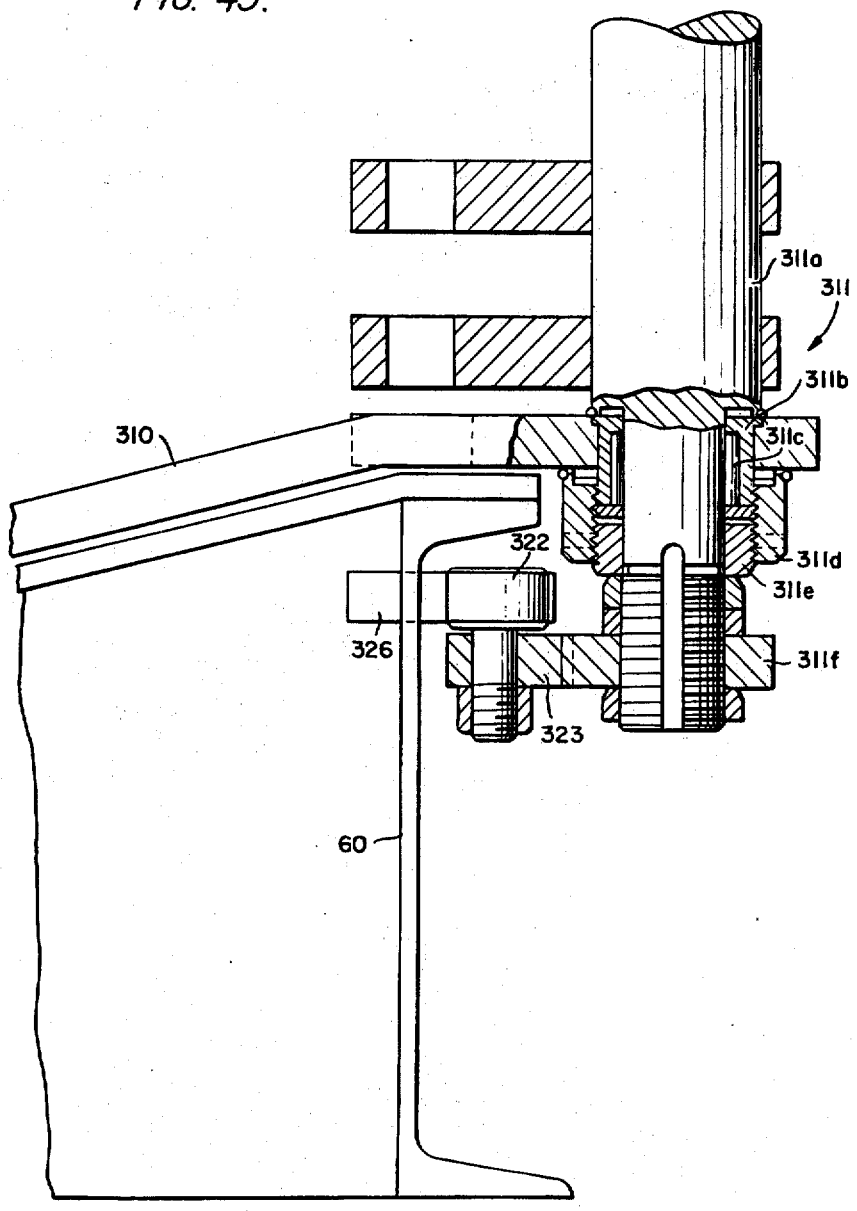
FIG. 45 is a fragmentary, partially broken away view of the bell crank assembly taken generally along line 45—45 of FIG. 43.
Figure 47:
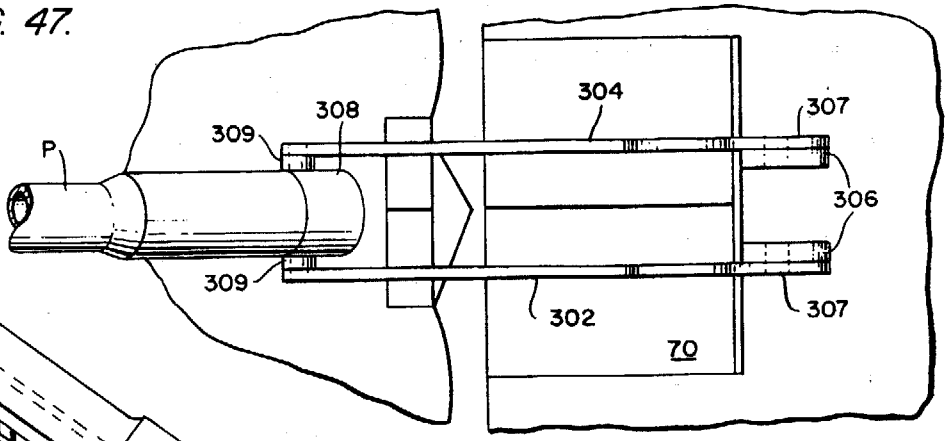
FIG. 47 is a partially broken away top plan view of the carriage of FIG. 46.
Figure 46:
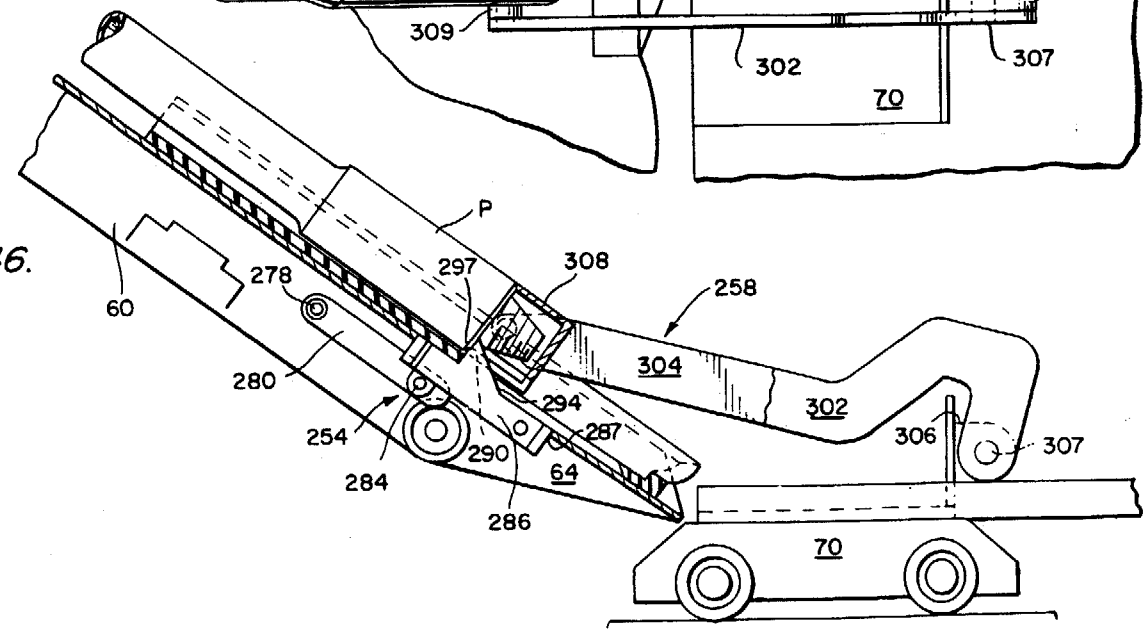
FIG. 46 is a partially broken away side elevational view of a preferred embodiment of the carriage of FIG. 24 illustrating the positioning of a length of pipe on the movable trough of FIG. 38, the superstructure of the bucket arrangement of FIG. 38 for clarities' sake has been omitted.
Figure 48:
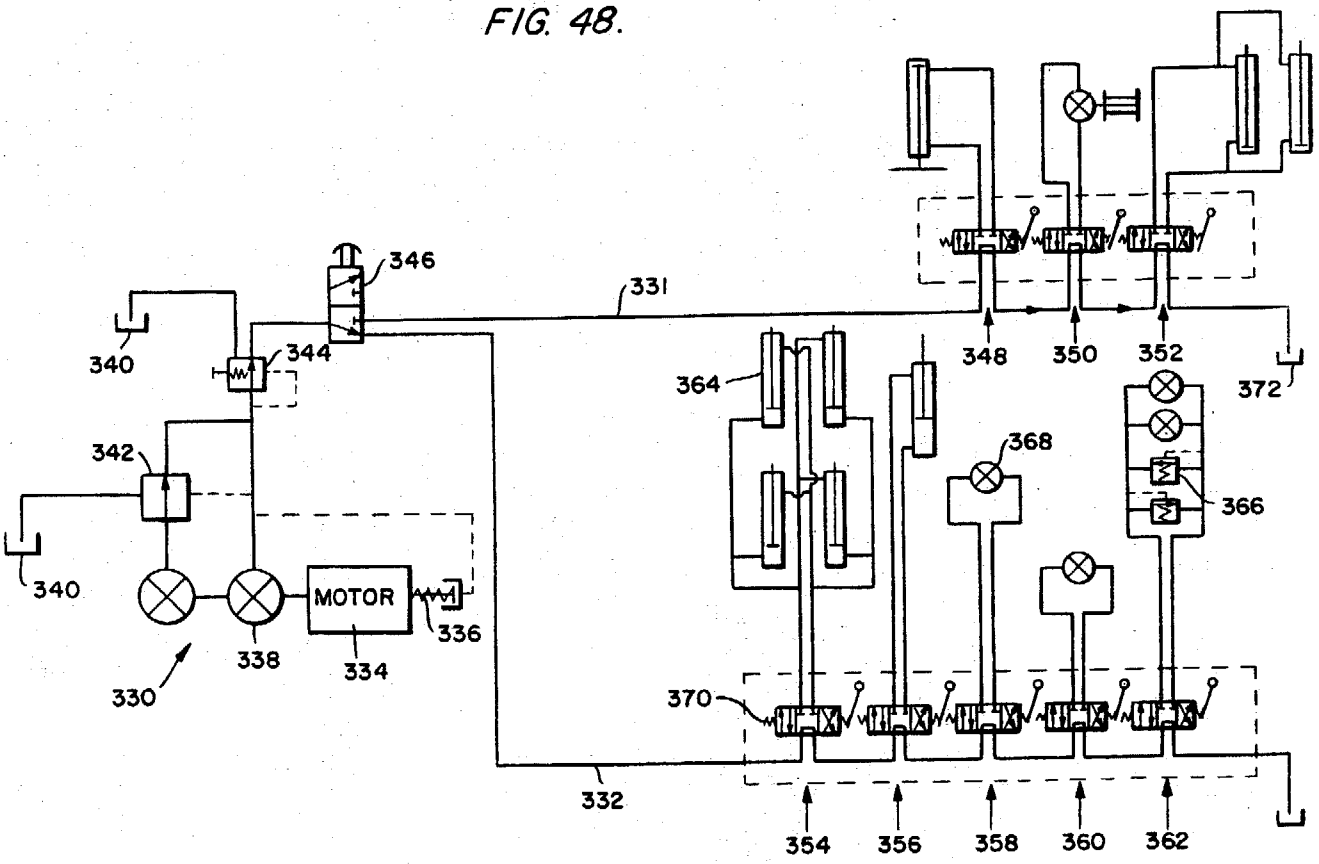
FIG. 48 is a schematic illustration of the hydraulic system for operating the apparatus of FIG. 1 further including the embodiment of FIG. 37.

The preferred embodiment of the present invention includes a bucket assembly shown generally at 252 in FIGS. 38–40 having a series of pairs of vertically disposed arms 256 to control the movement of pipe P along movable trough 60. In this embodiment clamps 75 are not used; rather, bucket assembly 252 prevents pipe P from sliding out of movable trough 60 as the trough moves up and down between masts 66, 66. In addition to holding the pipe in the trough, assembly 252 slides the pipe along movable trough 60. As best shown in FIGS. 41, 42 and 45, a latch mechanism shown generally at 254 is positioned along the centerline of end 64 for holding pipe P in movable trough 60. FIGS. 46 and 47 illustrate the push beam assembly shown generally at 258 of a preferred embodiment of carriage 70 pushing pipe P onto movable trough end 64 where it is held by latch mechanism 254 in movable trough 60.

Figure 37:
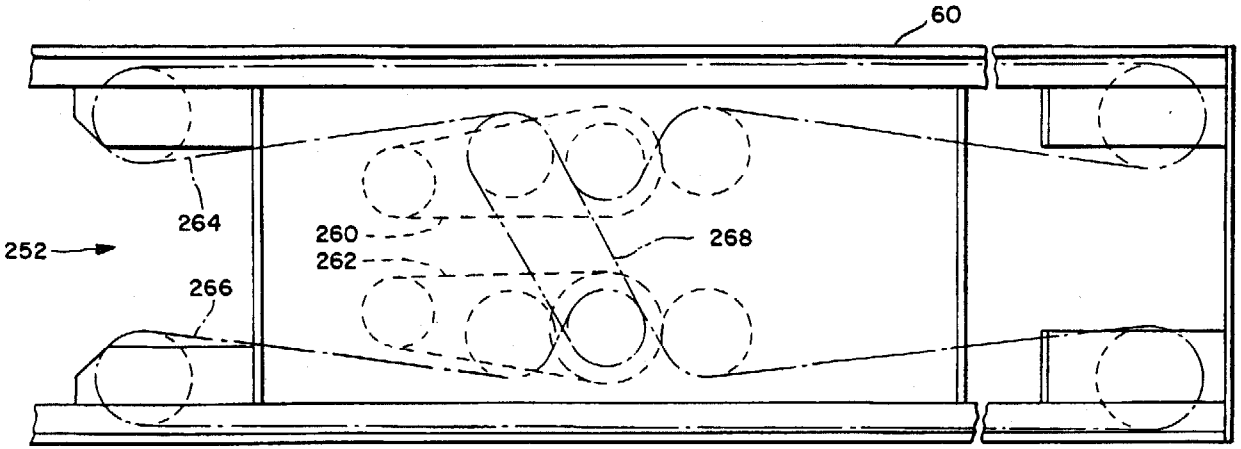
FIG. 37 is a fragmentary bottom schematic view of a preferred embodiment of the movable trough of FIG. 1 illustrating its bucket chain drive system.

Referring to FIG. 37, the routing of the drive chains is shown. Primary reduction chains which are shown at 260 and 262 are driven by a hydraulic motor (not shown). Bucket drive chains at 264 and 266 are driven by gears (not shown) which are driven by the primary reduction chains 260 and 262. Equalizer chain 268 ensures equal and parallel movements of bucket drive chains 264 and 266. Bucket assembly 252 is attached to the drive chains on both sides of movable trough 60 by chain attachment brackets 270, 270, as best shown in FIG. 38.

Latch cam plate 272, as best shown in FIGS. 38 and 41, is mounted on the outside of bucket assembly 252. As bucket assembly 252 is pulled along movable trough 60, latch cam plate 272 with cam surface 273 engages the cam follower 274, which is mounted on the latch cam lever 276 of latch mechanism 254, pushing it down. Latch cam lever 276 is mounted on shaft 278 as shown in FIGS. 41 and 42. Latch lever weldments 280, 280 are also mounted on shaft 278 positioned on opposite sides of the centerline of the movable trough. Thus, as latch cam plate 272 forces cam lever 276 down, shaft 278 rotates clockwise and latch lever weldments 280, 280 are pivoted with the shaft. The weldments are provided with registering slots 282 along which lever shaft 284 slides. Lever shaft 284 is mounted in pipe latch plate 286. Plate 286 is rotatably mounted to latch shaft 288 at its other end and includes a triangular latch portion 290. Shaft 288 is mounted in latch housing weldment 292 having an opening therethrough for latch plate 286. Thus, as latch lever weldments 280 are pivoted, as previously discussed, shaft 284 slides in slots 282 forcing pipe latch plate 286 down. When plate 286 is in its normal "up" position, latch portion 290 protrudes through an opening 281 along the center line of movable trough 60. As best shown in FIG. 46, triangular latch portion 290 is positioned so that its inclined surface 294 points down the movable trough toward the stationary trough. Thus pipe P may be slid from the stationary trough onto the movable trough whereby the pipe contacts inclined surface 294 forcing pipe latch plate 286 down. The pipe slides beyond latch portion 290 and pre-tensioned springs 296, 296, as best shown in FIG. 42, force pipe latch plate 286 back up. Springs 296, 296 are each positioned between latch lever weldments 280, 280 and attached at their end to attachment member **296*a* on shaft 278 and at their other end to attachment member 296*b* which is connected between latch lever weldments 280, 280. In the "up" position the pipe is held in movable trough 60 by the vertical surface 297 of latch portion 290. Latch cam plate 272 is so positioned and configured that its latch portion is in the "up" position when bucket assembly 252 is at movable trough end 64 and is in the "down" position as bucket assembly 252 is pulled up movable trough 60 to allow the bucket to pass over it. To allow pipe P to pass from movable trough 60 to stationary trough 54 the operator can cause latch portion 290 to be in the "down" position or latch cam plate 272 can cause latch portion 290** to be in the "down" position as the bucket assembly carrying the pipe passes over it.

Carriage 70 in the preferred embodiment shown in FIGS. 46 and 47 includes push beam assembly 258, which includes a pair of push beams 302 and 304 rotatably mounted at 307 on a pair of carriage pad eyes 306, 306. A pin tool cup 308 is pivotally mounted on opposed stub shafts 309, 309 between push beams 302 and 304 at their forward ends. When cup 308 engages pipe P in the stationary trough, the push beams are in a generally horizontal position. As the pipe is transferred between the two troughs, push beams 302 and 304 rotate about pad eye attachments at 307 and pin tool cup 308 rotates about stub shafts 309, 309.

Referring to FIGS. 38–40 and 43–45, bucket assembly 252 in addition to latch cam plate 272 includes a bucket portion 310 on which the pipe rests, a pair of bell crank assemblies 311, 311 positioned on either side of movable trough 60 and a series of vertically disposed pairs of arms 256, 256. The arms pivot between opened and closed positions about posts 314. Moving posts 316, as best shown in FIGS. 39, 40, 43 and 44, are pivotally attached to the arms and cause them to pivot about posts 314. Links 317 are each connected at one end to moving posts 316 and at the other to posts 318. Posts 318 are mounted by links 320 to bell crank assembly 311 so that as assembly 311 rotates, as described later, links 320 rotate, moving posts 318. Links 317 then move forcing moving posts 316 to rotate through the arm connection about posts 314 whereby the arms open and close.

Figure 44:
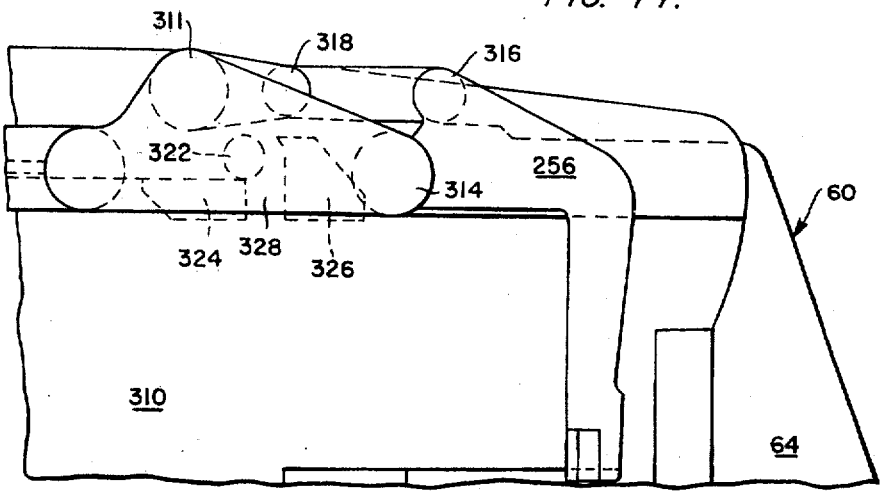
FIG. 44 is a view similar to that of FIG. 43 but of the other side of the movable trough and illustrating the bucket arms in the closed position.
Figure 43:
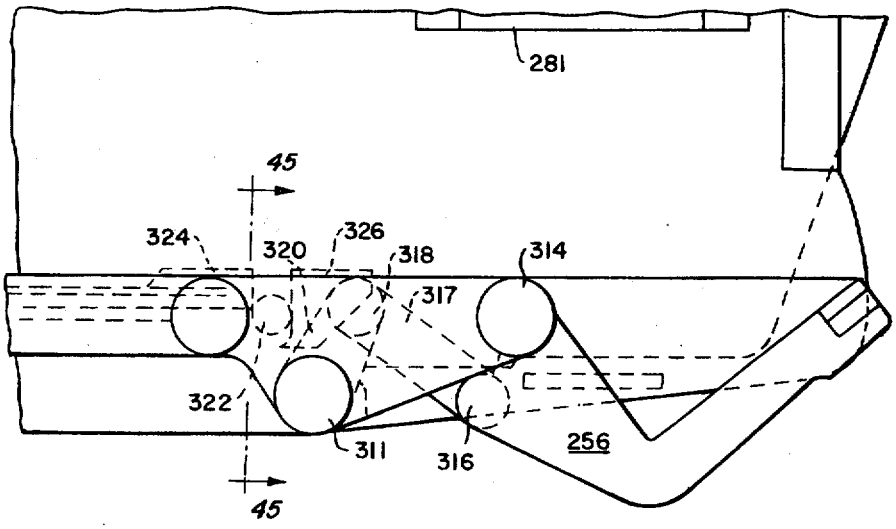
FIG. 43 is a fragmentary top plan view taken along line 43—43 in FIG. 38 illustrating the bucket arms in the open position.

Bell crank assemblies 311, 311 are positioned on opposite sides of and outside of movable trough 60. A cam follower 322 is positioned on an arm section 323 shown in FIG. 45 of the assembly disposed toward the sides of the movable trough. As best shown in FIGS. 43 and 44, a closing cam structure 324 and an opening cam structure 326 are spacedly mounted forming a cam slot 328 between them. Thus, as the bucket assembly is pulled along the movable trough, cam follower 322 is forced along cam slot 328. Bell crank assembly 311 is thus rotated by arm section 323 whereby links 320 are rotated and so forth. The broken away portion of FIG. 45 shows the inner bearing connections of bell crank assembly 311. The lower end of bell crank shaft **311*a* includes bearing housing 311*b*, caged roller bearing assembly 311*c*, adjustable thrust race 311*d*, and collar 311*e*. As can also be seen, cam follower 322 is mounted on driver plate 311*f***.

FIG. 46 is a schematic of the hydraulic system of the preferred embodiment and illustrates the pump assembly generally at 330, the mobilization-demobilization circuit 331 and the operational circuit 332. Pump assembly 330 includes a diesel engine 334, throttle control 336, pumps 338, reservoirs 340, pump unloading valve 342, pressure relief valve 344 and diverter valve 346. A jacking cylinder circuit 348, a winch circuit 350, and a mast circuit 352 are situated on mobilization-demobilization circuit 331. Circuits for the tilt trough 354, the high lift 356, the racking drive 358, the carriage drive 360, and the bucket drive 362 are included in operational circuit 332. The circuits include hydraulic cylinders 364, control valves 366, pumps 368, directional control valves 370, reservoirs 372 and appropriate flow lines.

From the foregoing detailed description, it will be evident that there are a number of changes, adaptations and modifications of the present inventions which come within the province of those persons having ordinary skill in the art to which the aforementioned inventions pertain. However, it is intended that all such variations not departing from the spirit of the inventions be considered as within the scope thereof as limited solely by the appended claims.

We claim:

1. An apparatus for transferring pipe or other tubulars to and from the floor of a drilling rig comprising:

stationary trough means for receiving and supporting pipe adapted to be located below the level of said drilling rig floor with one end extending toward said rig and located in proximity to said rig, support means located at said one end of said stationary trough means, movable trough means for receiving and supporting pipe aligned with said stationary trough means and having a first end coupled to said support means for generally vertical movement between a lower position and an upper position and having an opposite end adjacent said rig, said lower position being adjacent to said one end of said stationary trough means to permit the transfer of pipe between said movable and said stationary trough means, said upper position being generally above and substantially spaced from said one end of said stationary trough means, clamping means for holding pipe to said movable trough means as it moves between said lower and said upper positions, moving means for moving pipe lengthwise along said stationary trough means to said one end and onto said movable trough means when said first end of said movable trough means is in said lower position and for allowing pipe to move down said movable trough means when said movable trough means is in said lower position, power means for moving said first end of said movable trough means between said lower and upper positions, lifting means secured to said apparatus for raising said apparatus, and pivoting means cooperating with said lifting means to permit the pivoting of said apparatus.

2. An apparatus according to claim 1 further comprising:

a frame having an externally supported base section on which said stationary trough means is supported, said lifting means being operable to raise said frame and said base section from said external support and said pivoting means being connected to said lifting means to permit pivoting said frame about said lifting means.

3. An apparatus according to claim 2 wherein, said lifting means includes a fluid operated cylinder assembly mounted on said frame and a lifting plate cooperating with said cylinder assembly for engagement with an external support upon operation of said assembly to a raising position.

4. An apparatus according to claim 3 including, said lifting means being located along the axis of the center of gravity of said apparatus.

5. An apparatus according to claim 3 including, said lifting means including a ball means and said lifting plate including a socket means to receive said ball means whereby said lifting means permits pivoting of said apparatus.

6. An apparatus according to claim 5 further comprising:

dragging means for moving said apparatus along an external support.

7. An apparatus according to claim 1 further comprising:

dragging means for moving said apparatus along an external support.

8. An apparatus according to claims 7 or 6 wherein, said dragging means includes one or more winches.

9. An apparatus according to claim 1 including, said lifting means being located along the axis of the center of gravity of said apparatus.

10. An apparatus according to claim 9 including, said lifting means being positioned on said frame whereby in a raising position said lifting means engages an external support for said apparatus to raise said apparatus for pivotal movement and when in an inactive position said lifting means does not support said apparatus.

11. An apparatus for transferring pipe or other tubulars to and from the floor of a drilling rig comprising:

stationary trough means for receiving and supporting pipe adapted to be located below the level of said drilling rig floor with one end extending toward said rig and located in proximity to said rig, support means located at said one end of said stationary trough means, movable trough means for receiving and supporting pipe aligned with said stationary trough means and having a first end coupled to said support means for generally vertical movement between a lower position and an upper position and having an opposite end adjacent said rig, said lower position being adjacent to said one end of said stationary trough means to permit the transfer of pipe between said movable and said stationary trough means, said upper position being generally above and substantially spaced from said one end of said stationary trough means, moving means for moving pipe lengthwise along said stationary trough means to said one end and onto said movable trough means when said first end of said movable trough means is in said lower position and for allowing pipe to move down said movable trough means when said movable trough means is in said lower position, power means for moving said first end of said movable trough means between said lower and upper positions, bucket means operatively connected to said movable trough means for moving pipe along the length of said movable trough means, and driving means for driving said bucket along said movable trough means.

12. An apparatus according to claim 11 wherein, said bucket means includes at least one arm selectively positionable in an open position to allow said pipe to pass therethrough and in a closed position whereby said bucket means engages said pipe.

13. An apparatus according to claim 12 further comprising:

a latching mechanism operatively connected to said movable trough means for holding said pipe in said bucket means when each said arm is in said open position.

14. An apparatus according to claim 13 further comprising:

push means operatively connected to said carriage means for pushing said pipe onto said movable trough means for engagement with said latching mechanism.

15. An apparatus according to claim 14 further comprising:

follower means for closing said arm and disengaging said latching mechanism as said driving means begins to pull said bucket means away from said first end of said movable trough means toward said drilling rig floor.

16. An apparatus according to claim 15 wherein, said follower means engages said latching mechanism and opens said arm as said bucket means reaches said first end.

17. A method for moving an apparatus, which transfers pipe to and from pipe racks and a drilling rig, from a vehicle to a transferring position location adjacent the drilling rig comprising the steps of:

providing a stationary trough for said apparatus, providing a movable trough alignable with said stationary trough, supportable on said drilling rig and having first and second ends, providing a carriage for moving pipe between said stationary trough and said first end of said movable trough, positioning said vehicle adjacent said transferring position location, lifting said apparatus at its center of gravity, pivoting said lifted apparatus until it is longitudinally aligned with said transferring position location, dragging said apparatus off said vehicle to said transferring positioning location, engaging said first end of said movable trough to said carriage, and lifting said second end toward said drilling rig and simultaneously pushing said first end with said carriage towards said drilling rig until said second end is supported on said drilling rig and said first end is aligned with said stationary trough.

18. The method of claim 17, further comprising the steps of:

providing a mechanism for moving pipe between said stationary trough and said pipe racks, and attaching said mechanism to said stationary trough.

19. The method of claim 17, wherein said lifting includes:

the actuating of a fluid operated cylinder assembly mounted on said apparatus.

20. The method claim 17, further comprising the step of:

providing a bucket assembly for moving pipe between said first end of said movable trough along said movable trough to said drilling rig.

21. An apparatus for transferring pipe or other tubulars to and from the floor of a drilling rig comprising:

stationary trough means for receiving and supporting pipe adapted to be located below the level of said drilling rig floor with one end extending toward said rig and located in proximity to said rig, support means located at said one end of said stationary trough means, movable trough means for receiving and supporting pipe aligned with said stationary trough means and having a first end coupled to said support means for generally vertical movement between a lower position and an upper position and having an opposite end adjacent said rig, said lower position being adjacent to said one end of said stationary trough means to permit the transfer of pipe between said movable and said stationary trough means, means for holding pipe in said movable trough means as said movable trough means moves between said lower and said upper positions, moving means for moving pipe lengthwise along said stationary trough means to said one end and onto said movable trough means when said first end of said movable trough means is in said lower position and for allowing pipe to move down said movable trough means when said movable trough means is in said lower position, power means for moving said first end of said movable trough means between said lower and upper positions, said moving means including carriage means for engaging pipe and positioned for movement along said stationary trough means, carriage power means secured to said carriage means by an endless chain for moving said carriage means along said stationary trough means, and dampening means associated with said carriage means for absorbing forces caused when a pipe or the like impacts said carriage means, said dampening means comprising a first sprocket and a second sprocket having first and second axes of rotation, respectively, positioned in spaced relation, and engaging said endless chain, a third sprocket having a third axis of rotation, positioned between said first and second sprockets and engaging said endless chain, said third axis being offset from the line defined by said first and second axes, and a shock absorber pivotally connected at one end to said third sprocket and at a second end to said stationary trough means.

22. An apparatus according to claim 21 wherein, said dampening means includes a bell crank having first and second leg portions and a middle fulcrum portion therebetween, said first leg portion is pivotally connected to said third sprocket, said middle fulcrum portion is pivotally connected to said stationary trough means, and one end of said shock absorber is pivotally connected to said second leg portion and a second end is attached to said stationary trough means.

23. An apparatus according to claim 21 wherein, said shock absorber comprises spring means.

24. An apparatus according to claim 1 wherein, said shock absorber comprises hydraulic shock absorber means.

25. An apparatus according to claim 21 wherein, said shock absorber includes more than one alternating, aligned resilient and nonresilient annular segments.

26. An apparatus according to claim 25 wherein, said resilient annular segments are rubber and said nonresilient annular segments are metal.

27. An apparatus for transferring pipe or other tubulars to and from the floor of a drilling rig comprising:

stationary trough means for receiving and supporting pipe adapted to be located below the level of said drilling rig floor with one end extending toward said rig and located in proximity to said rig.

support means located at said one end of said stationary trough means, movable trough means for receiving and supporting pipe aligned with said stationary trough means and having a first end coupled to said support means for generally vertical movement between a lower position and an upper position and having an opposite end adjacent said rig, said lower position being adjacent to said one end of said stationary trough means to permit the transfer of pipe between said movable and said stationary trough means, said upper position being generally above and substantially spaced from said one end of said stationary trough means, means for holding pipe in said movable trough means as said movable trough means moves between said lower and said upper positions, moving means for moving pipe lengthwise along said stationary trough means to said one end and onto said movable trough means when said first end of said movable trough means is in said lower position and for allowing pipe to move down said movable trough means when said movable trough means is in said lower position, power means for moving said first end of said movable trough means between said lower and upper positions, a frame positioned below said stationary trough means on which said stationary trough means is supported, said support means including a pair of masts attached to opposite sides of said frame at said one end of said stationary trough means, each of said masts including an upper portion extending generally vertically above said stationary trough means and a lower portion positioned below said upper portion, folding means connected to said masts for folding said upper portion between a generally vertical position and a position generally parallel to said stationary trough means, said folding means including a first member attached to and extending horizontally out from said upper portion, a second member attached to and extending horizontally out from said lower portion, a cylinder means coupled at one end to said first member and at its opposite end to said second member, and a hinge assembly connected to said mast between said first and second members and having a pivot axis fixed relative to said lower portion, and positioned generally on the same side of said masts as said cylinder means and about which said upper portion pivots, and said hinge assembly includes an upper member connected to and extending from said upper portion below said first member, a lower member connected to and extending from said lower portion above said second member, and a pivot pin positioned outside of said masts and passing through registered openings in said upper and lower members and retained therein.

28. An apparatus according to claim 27 wherein, said hinge assembly includes a securing means for controllably securing said upper portion in said vertical position.

29. An apparatus according to claim 28 wherein, said securing means includes pin means positionable in openings in said upper and lower members which are in mutual registration when said upper portion is in said vertical position.

30. An apparatus according to claim 29 wherein, said pin means is positioned on the opposite side of said masts as said pivot pin.

31. An apparatus according to claim 27 wherein, said second member is attached to said lower portion at a point spaced above said stationary trough means.

32. An apparatus according to claims 1, 11, 21 or 27, further comprising:

a frame supporting said stationary trough means, and handling means positioned on said apparatus for transferring pipe between said stationary trough means and at least one pipe rack positioned on at least one of said stationary trough means, said handling means including one or more arms pivotally connected at one end to said frame, said arm including a pipe abutment portion at its other end, a fluid actuated cylinder pivotally connected at one end to said frame and at the other end to said arm whereby when said cylinder is retracted said pipe can be transferred between said pipe racks and said arm and when said arm is extended said pipe can be transferred between said arm and said stationary trough means.

33. An apparatus according to claim 32 wherein, said arm comprises a first arm portion pivotally connected at one end to said frame and a second arm portion having first and second ends, said first end being removably mounted to the other end of said first arm and said second end including said pipe abutment portion.

34. An apparatus according to claim 33 wherein, said second arm portion is selected from a group of arm portions of differing lengths whereby said handling means can be adjusted for differing levels of rows of pipe in said pipe racks.

35. An apparatus according to claims 1, 11, 21 or 27 further comprising:

a frame supporting said stationary trough means, and handling means positioned on said apparatus for transferring pipe between said stationary trough means and at least one pipe rack positioned on at least one side of said stationary trough means, said handling means including one or more pairs of legs pivotally attached to said frame, each said leg including an upper leg portion and a lower leg portion, and coupling means for attached said leg portions together and for folding said lower leg portion towards said upper leg portion.

36. An apparatus according to claim 35 wherein, said coupling means includes a plurality of pivot pins mutually cooperating to fold said lower leg portion.

37. An apparatus according to claim 36 wherein, said coupling means further includes pivot link means connecting said pivot pins.

38. An apparatus according to claim 35 wherein, said coupling means includes a first pin connected to the lowermost end of said upper leg, a second pin connected to the uppermost end of said lower leg and at least one link pivotally connected to said first pin and said second pin whereby said lower leg may be folded up in a position generally parallel with said upper leg.

39. An apparatus according to claim 35 further comprising:

locking means for securing said lower leg in said generally parallel position.

40. An apparatus according to claim 38 further comprising, a transfer means mounted on each said leg and a pipe cradling lug connected to said transfer means for contact with the pipe for moving said pipe along said leg.

41. An apparatus according to claim 35 further comprising:

a transfer means mounted to each said leg and a pipe cradling lug connected to said transfer means for contact with a pipe.

42. An apparatus according to claim 41 wherein, said transfer means includes a chain means connected at opposite ends to each of said lugs, and a chain drive means for driving said chain means whereby said lugs are caused to move in opposite directions.

43. A method for transferring pipe or the like to and from the floor of a drilling rig comprising the steps of:

providing a first trough, moving said pipe into said first trough, providing a second trough having a first end supported on said drilling rig and a second end aligned with said first trough, sliding said pipe from said first trough into said second trough, raising said second end of said second trough in a manner whereby said first end slides further onto said drilling rig, pushing said pipe positioned in said second trough in a direction away from said first trough and towards said drilling rig, after said raising means has raised said second end of second trough so that it is spaced from said first trough, and in, parallel to, and lengthwise along said second trough towards said drilling rig, said sliding step including providing a carriage movably connected to said first trough, engaging said carriage to said pipe, and moving said carriage along said first trough to said second trough whereby said pipe is slid entirely onto said second trough, said pushing step including providing a holding member movably connected to said second trough, engaging said holding member to said pipe positioned in said second trough, and moving said holding member along said second trough towards said drilling rig floor, and said moving said carriage step being operatively associated with said engaging said holding member step.

44. A method for transferring pipe or the like to and from the floor of a drilling rig comprising the steps of:

providing a first trough, moving said pipe into said first trough, providing a second trough having a first end supported on said drilling rig and a second end aligned with said first trough, sliding said pipe from said first trough into said second trough, securing said pipe in said second trough, raising said second end of said second trough in a manner whereby said first end slides further onto said drilling rig floor, and removing said pipe from said second trough onto said drilling rig floor, said removing step including providing a bucket operatively connected to said second trough, engaging said bucket around the lower end of said pipe and moving said bucket along said second trough pushing said pipe along said second trough toward said drilling rig floor.

45. An apparatus for transferring pipe or other tubulars to and from the floor of a drilling rig comprising:

stationary trough means for receiving and supporting pipe adapted to be located below the level of said drilling rig floor with one end extending toward said rig and located in proximity to said rig, support means located at said one end of said stationary trough means, movable trough means for receiving and supporting pipe aligned with said stationary trough means and having a first end coupled to said support means for generally vertical movement between a lower position and an upper position and having an opposite end adjacent said rig, said lower position being adjacent to said one end of said stationary trough means to permit the transfer of pipe between said movable and said stationary trough means, said upper position being generally above and substantially spaced from said one end of said stationary trough means, moving means for moving pipe lengthwise along said stationary trough means to said one end and onto said movable trough means when said first end of said movable trough means is in said lower position and for allowing pipe to move down said movable trough means when said movable trough means is in said lower position, power means for moving said first end of said movable trough means between said lower and upper positions, holding means operatively connected to said movable trough means for holding said pipe in said movable trough means, said holding means being releasable to allow pipe to pass between said movable trough means and said stationary trough means, and pushing means for pushing the lower end of said pipe entirely onto said movable trough means for engagement with said holding means.

46. An apparatus according to claim 45 wherein, said holding means is releasable to allow pipe to pass between said movable trough means and said stationary trough means.

47. An apparatus according to claim 45 wherein, said pushing means is operatively connected to said moving means.

48. An apparatus according to claim 47 wherein, said pushing means includes at least one arm pivotally connected to said moving means at one end and having a pipe end contact member at an opposite end.

49. An apparatus for transferring pipe or other tubulars to and from the floor of a drilling rig comprising:

stationary trough means for receiving and supporting pipe adapted to be located below the level of said drilling rig floor with one end extending toward said rig and located in proximity to said rig, support means located at said one end of said stationary trough means, movable trough means for receiving and supporting pipe aligned with said stationary trough means and having a first end coupled to said support means for generally vertical movement between a lower position and an upper position and having an opposite end adjacent said rig, said lower position being adjacent to said one end of said stationary trough means to permit the transfer of pipe between said movable and said stationary trough means, said upper position being generally above and substantially spaced from said one end of said stationary trough means, moving means for moving pipe lengthwise along said stationary trough means to said one end and on to said movable trough means when said first end of said movable trough means is in said lower position and for allowing pipe to move down said movable trough means when said movable trough means is in said lower position, power means for moving said first end of said movable trough means between said lower and upper positions, holding means operatively connected to said movable trough means for holding said pipe and said movable trough means, and pushing means operatively connected to said moving means for pushing the lower end of said pipe entirely onto said movable trough means for engagement with said holding means.

50. An apparatus according to claim 49 wherein, said pushing means includes at least one arm pivotally connected to said moving means at one end and having a pipe end contact member at an opposite end.

* * * * *